US006491834B1

(12) United States Patent
Kubota et al.

(10) Patent No.: US 6,491,834 B1
(45) Date of Patent: Dec. 10, 2002

(54) METHOD FOR MANUFACTURING LIQUID DISCHARGE HEAD, LIQUID DISCHARGE HEAD, HEAD CARTRIDGE, AND LIQUID DISCHARGE RECORDING APPARATUS

(75) Inventors: Masahiko Kubota, Tokyo (JP); Ichiro Saito, Yokohama (JP); Toshio Kashino, Chigasaki (JP); Yoshiyuki Imanaka, Kawasaki (JP); Teruo Ozaki, Yokohama (JP); Muga Mochizuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,210

(22) Filed: Dec. 1, 1999

(30) Foreign Application Priority Data

Dec. 3, 1998 (JP) ..... 10-344731

(51) Int. Cl.[7] ..... B41J 2/05

(52) U.S. Cl. ..... 216/27; 216/17; 216/67; 347/9; 347/20; 347/84; 347/92

(58) Field of Search ..... 216/13, 14, 17, 216/27, 67; 347/1, 9, 20, 84, 85, 92

(56) References Cited

U.S. PATENT DOCUMENTS

| | | | | |
|---|---|---|---|---|
| 4,723,129 A | | 2/1988 | Endo et al. | 346/1.1 |
| 5,278,585 A | * | 1/1994 | Karz et al. | 346/140 |
| 5,838,351 A | | 11/1998 | Weber | 347/85 |
| 6,070,968 A | * | 6/2000 | Akino et al. | 347/59 |
| 6,213,589 B1 | * | 4/2001 | Silverbrook | 347/54 |
| 6,227,653 B1 | * | 5/2001 | Silverbrook | 347/54 |
| 6,239,821 B1 | * | 5/2001 | Silverbrook | 347/54 |

FOREIGN PATENT DOCUMENTS

| | | | | |
|---|---|---|---|---|
| EP | 0436047 A1 | * | 10/1991 | B41J/2/055 |
| EP | 0665590 A2 | | 8/1995 | H01L/23/00 |
| EP | 0721841 A2 | * | 7/1996 | B41J/2/05 |
| EP | 0813967 A2 | | 12/1997 | B41J/2/14 |
| EP | 0819528 A2 | * | 1/1998 | B41J/2/05 |
| EP | 0920998 A2 | | 6/1999 | B41J/2/05 |
| EP | 0976562 A2 | | 2/2000 | B41J/2/14 |
| JP | 9048127 A | * | 2/1997 | B41J/3/04 |
| JP | 9-201966 | | 8/1997 | |
| JP | 9323420 A | * | 12/1997 | B41J/3/04 |
| JP | 10024588 A | * | 1/1998 | |

* cited by examiner

*Primary Examiner*—Randy Gulakowski
*Assistant Examiner*—J Smetana
(74) *Attorney, Agent, or Firm*—Fitzpatrick, Cella, Harper & Scinto

(57) ABSTRACT

A method for manufacturing a liquid discharge head, which is provided with discharge ports for discharging liquid; liquid flow paths communicated with the discharge ports for supplying the liquid to the discharge ports; heat generating elements arranged in the liquid flow paths for creating bubbles in the liquid; an elemental substrate having the heat generating elements therefor; and movable members arranged for the elemental substrate having each free end thereof on the discharge port side with a gap with the elemental substrate in the position facing the heat generating element on the elemental substrate, each free end of the movable members being displaced on the discharge port side centering on the fulcrum structured near the supporting and fixing portion with the elemental substrate by the pressure exerted by the creation of the bubbles for discharging the liquid form the discharge ports, comprises the steps of forming gap formation members; forming the material film; pattering the material film; and forming the gap.

24 Claims, 17 Drawing Sheets

METHOD FOR MANUFACTURING LIQUID DISCHARGE HEAD, LIQUID DISCHARGE HEAD, HEAD CARTRIDGE, AND LIQUID DISCHARGE RECORDING APPARATUS

BACKGROUND OF THE INVENTION

1. Field of the Invention

The present invention relates to a method for manufacturing a liquid discharge head used for a printer, a video printer, or the like serving as the output terminal for a copying machine, a facsimile equipment, a word processor, or a host computer, among some others. The invention also relates to a liquid discharge head manufactured by such method of manufacture, and a head cartridge, as well as to a liquid discharge recording apparatus. More particularly, the invention relates to a method for manufacturing a liquid discharge head provided with an elemental substrate having the electrothermal transducing elements formed thereon to generate thermal energy which is utilized for discharging liquid, a liquid discharge head manufactured by such method of manufacture, a head cartridge, and a liquid discharge recording head as well. In other words, the invention relates to a method for manufacturing a liquid discharge head which is used for recording by discharging ink or other recording liquid from the discharge ports (orifices) as flying droplets which adhere to a recording medium. The invention also relates to a liquid discharge head manufactured by such method of manufacture, and a head cartridge, as well as to a liquid discharge recording apparatus.

2. Related Background Art

There has been known the ink jet recording method, that is, the so-called bubble jet recording method, in which heat or some other energy is applied to ink to change the states thereof with abrupt voluminal changes to follow, and ink is discharged from each of the discharge ports by the acting force based upon this change of states of ink, and then, ink is caused to adhere to a recording medium for the image formation. Here, as disclosed in the specification of U.S. Pat. No. 4,723,129, the recording apparatus that uses this bubble jet recording method is generally provided with the discharge ports through which ink is discharged; the ink flow paths communicated with the discharge ports; and the electrothermal transducing elements serving as energy generating means for discharging ink.

In accordance with such method, it is possible to record images in high quality at high speed, and in a lesser amount of noises, and at the same time, it is possible to arrange the discharge ports for discharging ink in high density. Therefore, among many advantages, images can be formed in high resolution with a smaller apparatus, and also, color images can be also obtained as the excellent advantage of the method. In recent years, the bubble jet recording method has been widely utilized for a printer, a copying machine, a facsimile equipment, and many other office equipment. This method begins to be utilized even for a textile printing system and others for industrial use because of such advantages described above.

Meanwhile, along with the wider utilization of the bubble jet technologies and techniques for products in many fields, the various demands have been made more increasingly more in recent years as given below.

For example, the optimization of heat generating elements may be cited as the one that requires further studies on the enhancement of the energy efficiency, such as the adjustment of the thickness of the protection film provided for each of the heat generating elements. This technique is considered effective with respect to the improvement of the transfer efficiency of the generated heat to liquid.

Also, to obtain images in high quality, there has been proposed the driving condition that may implement the liquid discharge method which makes ink discharges at higher speeds with excellent ink discharges by the stable creation of bubbles. Also, from the viewpoint of the higher recording, there has been proposed an improved configuration of liquid flow paths for the provision of a liquid discharge head having the higher refilling speed of liquid to compensate for the amount of liquid that has been discharged.

Further, returning to the principle of liquid discharges, ardent studies have been made to provide a new liquid discharge method as disclosed in the specification of Japanese Patent Application Laid-Open No. 9-201966 and some others for the provision of heads and others by the utilization of bubbling, which has never been obtainable by the application of the conventional art.

Here, with reference to FIGS. 18A to 18D to FIG. 20, the description will be made of the conventional liquid discharge method disclosed in the specification of Japanese Patent Application Laid-Open No. 9-201966 and others, and also, of the head that uses such method. FIGS. 18A to 18D are views which illustrate the discharge principle of the conventional liquid discharge head. FIGS. 18A to 18D are cross-sectional view thereof, taken in the liquid flow path direction, respectively. Also, FIG. 19 is a partially broken perspective view which shows the liquid discharge head represented in FIGS. 18A to 18D. FIG. 20 is a cross-sectional view which shows the variational example of the liquid jet head represented in FIGS. 18A to 18D. The liquid discharge heads shown in FIGS. 18A to 18D and FIG. 20 represent the most fundamental structure for the provision of the enhanced discharge power and discharge efficiency by the control of the propagating direction of the pressure exerted by bubbling, as well as the direction of bubble development for the liquid discharges.

The terms "upstream" and "downstream" used for the following description are related to the flow direction of liquid toward the discharge ports from the supply source of the liquid through the bubble generating areas, and these terms are also meant to indicate the structural direction thereof.

Also, the term "downstream side" related to the bubble itself means the discharge port side of the bubble that mainly acts directly upon the liquid droplet discharge. More specifically, with respect to the center of the bubble, this means the downstream side related to the aforesaid flow direction or the aforesaid structural direction or it means the bubble which is created on the area on the downstream side of the area center of the heat generating element. (Likewise, the term "upstream side" related to the bubble itself means the upstream side in the aforesaid flow direction or the aforesaid structural direction with respect to the center of the bubble or this means the bubble created on the area on the upstream side of the area center of the heat generating element.)

Also, the term "comb teeth" is meant to indicate the configuration of a movable member where the front of its free end is released with the supporting point of the movable member being a common member.

For the liquid discharge head shown in FIGS. 18A to 18D, the heat generating element 102 that activates thermal energy on liquid as discharge energy generating element for discharge liquid is provided for the elemental substrate 101. On the elemental substrate 101, the liquid flow path 103 is arranged corresponding to the heat generating element 102. The liquid flow path 103 is communicated with the discharge port 104, and at the same time, communicated with the common liquid chamber 105 that supplies liquid to a plurality of liquid flow paths 103, which receives liquid in an amount equivalent to that of liquid having been discharged from the discharge port 104, respectively.

On the portion of the elemental substrate 101 that corresponds to the liquid flow path 103, the plate type movable member 106 is arranged in a cantilever fashion with its plane portion that faces the heat generating element 102. The movable member 106 is formed by an elastic metal material or the like. One end of the movable member 106 is fixed to the pedestal 107 formed by patterning the photosensitive resin on the walls of the liquid flow path 103 or on the elemental substrate 101. In this manner, the movable member 106 is supported by the pedestal 107 to constitute the fulcrum 108 of the movable member 106.

Also, with the movable member 106 formed to be the comb teeth shape, it becomes easier to produce the movable member 106 easily at lower costs. Also, the alignment of the movable member 106 can be easily made to the pedestal 107. The movable member 106 has its fulcrum 108 on the upstream side in a large flow from the common liquid chamber 105 to the discharge port 104 side through above the movable member 106 at the time of operating the liquid discharge. The movable member is arranged in a position to face the heat generating element 102 to cover the heat generating element 102 with a gap of approximately 15 $\mu$m with the heat generating element 102 so that it has the free end 109 on the downstream side of the fulcrum 108. There is each of the bubble generating areas 110 between the heat generating element 102 and the movable member 106.

Now, with reference to FIGS. 18A to 18D, the description will be made of the operation of the liquid discharge head structured as described above.

At first, in FIG. 18A, ink is filled on the bubble generating area 110 and in the interior of the liquid flow path 103.

Then, in FIG. 18B, when the heat generating element 102 is energized, heat is applied to liquid on the bubble generating area 110 between the movable member 106 and the heat generating element 102. Then, bubble 111 is created in liquid on the basis of the film boiling phenomenon disclosed in the specification of U.S. Pat. No. 4,723,129 or the like. The pressure exerted by the creation of the bubble 111, and the bubble 111 act upon the bubble 111 priorly. Then, the movable member 106 is displaced so that it opens largely on the discharge port 104 side centering on the fulcrum 108 as shown in FIG. 18B, FIG. 18C or FIG. 19. By with the propagation of the pressure exerted by the bubble 111 by the displacement of the movable member 106 or by the displaced condition thereof or with the width provided for the leading end of the bubble 109, it becomes easier to lead the bubbling power of the bubble 111 to the discharge port 104 side. Thus, the fundamental enhancement can be attempted as to the discharge efficiency of the liquid droplets 132, the discharge power, the discharge speed, or the like. Here, in FIG. 19, a reference numeral 130 designates the area center of the heat generating element.

As described above, the technologies and techniques disclosed in the specification of Japanese Patent Application Laid-Open No. 9-201966 and others are those which control bubbles positively by changing the relationship between the fulcrum and free end of the movable member in the liquid path so that the free end of the movable member is positioned on the discharge port side, that is, on the downstream side, and also, by arranging the movable member to face the heat generating element or the bubble generating area.

Now, the liquid discharge head shown in FIG. 20 is also provided with the elemental substrate 201, the heat generating element 202, the liquid flow path 203, the discharge port 204, the common liquid chamber 205, and the bubble generating area 209, each structure of which is the same as each of those constituting the liquid discharge head described in conjunction with FIGS. 18A to 18D, respectively. Therefore, the detailed description thereof will be omitted.

For the movable member 206 formed in a cantilever fashion for the liquid discharge head shown in FIG. 20, a stepping portion is provided on one end at 206*a*. The movable member 206 is thus fixed onto the elemental substrate 201 directly. The movable member 206 is held on the elemental substrate 201. Then, the fulcrum 207 of the movable member 206 is formed with the free end 208 which is structured on the downstream side of the fulcrum 207.

As described above, with the provision of the pedestal for the fixing portion of the movable member or the stepping portion for the fixing portion of the movable member, the gap of approximately 1 to 20 $\mu$m is formed between the movable member and the heat generating member so as to sufficiently produce effect by the movable member on the enhancement of the liquid discharge efficiency. Therefore, in accordance with the liquid discharge head or the like which is based on the discharge principle described above, it becomes possible to obtain the synergetic effect by the application of the bubbles thus created and the movable members which can displace by the creation of bubbles. Then, as compared with the discharge method and the liquid discharge head of the conventional bubble jet type which does not use any movable members, the liquid discharge efficiency is enhanced.

SUMMARY OF THE INVENTION

The main subject of the present invention is to provide the fundamental discharge characteristics of the liquid discharge method of the basic type, in which the conventional bubbles, particularly the bubbles which are created following the film boiling, are formed in the liquid flow paths, at a higher level which has never been expected in accordance with the conventional art.

The inventors hereof have ardently studied a new liquid discharge method that utilizes the bubbles which have never been obtainable by the conventional art in order to provide a head that uses such method. During the studies that the inventors have made, it has been attempted to carry out a first technical analysis on the principle of the mechanism for the movable member in the liquid flow path, beginning with the operation of the movable member in the liquid flow path; a second technical analysis beginning with the principle of the liquid discharge by the application of bubbles; and a third technical analysis beginning with the bubble generating area of the heat generating member for use of the bubble creation. Based on these analyses, the inventors hereof have established a completely new technology with which to control bubbles positively by making the positional relationship between the fulcrum and free end of the movable member so as to position the free end thereof on the discharge port side, that is, on the downstream side, and also, by arranging the movable member to face the heat generating element or the bubble generating area.

Then, in consideration of the energy generated by the bubble itself which exerts influences on the discharge amount, the inventors hereof have acquired the knowledge that the development component of the bubble on the downstream side is the largest factor that should be taken into account for the significant enhancement of the discharge characteristics. In other words, it has been found that the effective transformation of the development component of the bubble on the downstream side in the discharge direction is the one that may bring about the enhancement of the discharge efficiency, and discharge speed as well.

Further, it has been found that the structural elements should preferably be taken into account as to the heat generating area for the bubble formation, that is, the downstream side of the center line running through the area center of the electrothermal transducing element in the flow direction, for example, or the movable member and the liquid flow path which are related to the development of the bubble on the downstream side of the area center of the plane that may deal with bubbling, among some others.

Also, on the other hand, it has been found that the refilling speed can be enhanced significantly with the consideration given to the arrangement of the movable member, as well as to the structure of the liquid supply path.

Now, it is an object of the present invention to provide a method for manufacturing a liquid discharge head capable of manufacturing the highly reliable liquid discharge head whose discharge characteristics are stabilized when liquid is discharged by the utilization of the displacement of the free ends of the movable members by the pressure exerted by the creation of bubbles, and also, to provide the liquid discharge head which is manufactured by such method of manufacture, as well as the head cartridge and the liquid discharge recording apparatus. Also, it is another object of the invention to provide a method for manufacturing the liquid discharge head for which the movable members and others of the liquid discharge head can be formed in high precision and in high density. It is still another object of the invention to provide a method for manufacturing the liquid discharge head capable of performing high quality recording, and also, maintaining stabilized discharges without almost no changes in the flow resistance of the liquid flow paths, the close contactness between the elemental substrate and the flow path walls, and also, in the positions of the movable members and the liquid flow paths with respect to the heat generating elements even when the head temperature changes along the high speed printing or the like.

In order to achieve the objects discussed above, the method of the present invention for manufacturing a liquid discharge head, which is provided with a discharge port for discharging liquid; a liquid flow path communicated with the discharge port for supplying the liquid to the discharge port; a heat generating element arranged in the liquid flow path for creating a bubble in the liquid; an elemental substrate having the heat generating element therefor; and a movable member arranged for the elemental substrate having the free end thereof on the discharge port side with a gap with the elemental substrate in the position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, comprises the steps of: forming a gap formation member with Al to form the gap between the elemental substrate and the movable member on the surface of the elemental substrate on the heat generating element side; forming the material film for the formation of the movable member so as to cover the gap formation member; patterning the material film by dry etching; and forming the gap by eluting the gap formation member. Here, the gap formation member formed with Al is extended to be the etching area of the material film in this method of manufacture.

In order to achiever the objects discussed above, the method of the present invention for manufacturing a liquid discharge head, which is provided with discharge port for discharging liquid; a liquid flow path communicated with the discharge port for supplying the liquid to the discharge port; a heat generating element arranged in the liquid flow path for creating bubble in the liquid; an elemental substrate having the heat generating element therefor; and a movable member arranged for the elemental substrate having the free end thereof on the discharge port side with a gap with the elemental substrate in the position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, comprises the steps of forming a gap formation member with Al to form the gap between the elemental substrate and the movable member on the surface of the elemental substrate on the heat generating element side; forming the material film for the formation of the movable member so as to cover the gap formation member; pattering the material film by dry etching; and forming the gap by eluting the gap formation member. Here, the gap formation member formed with Al is extended to the etching area of the material film in this method of manufacture.

Also, a method of the present invention method for manufacturing a liquid discharge head, which is provided with a discharge port for discharging liquid; a liquid flow path communicated with the discharge port for supplying the liquid to the discharge port; an elemental substrate having a heat generating element provided for one face side thereof for creating bubble in the liquid in the liquid flow path; a liquid flow path side wall formed on the elemental substrate to form the liquid flow path; and a movable member arranged for the elemental substrate, having the free end on the discharge port side with a gap with the elemental substrate in the position facing the heat generating element on the elemental substrate, and then, the free end of the movable member being displaced on the discharge port side centering on the fulcrum structured near the supporting and fixing portion with the elemental substrate by the pressure exerted by the creation of the bubble for discharging the liquid from the discharge port, comprises the steps of forming a gap formation member locally for the formation of the gap between the elemental substrate and the movable member on the surface of the elemental substrate on the heat generating element side; forming the silicon material film for the formation of the movable member on the surface of the elemental substrate on the heat generating element side; forming a first mask layer on the surface portion of the material film for the formation of the movable member corresponding to the movable member; forming the silicon material film for the formation of the flow path side wall on the surface of the material film for the formation of the movable member and the surface of the first mask layer; forming a second mask layer on the surface portion of the film for the formation of the flow path side wall; forming at least a part of the liquid flow path and the flow path side wall by patterning the material film for the formation of movable member and the film for the formation of the flow path side wall by etching using the first and second masks, and removing the gap formation member and the second mask layer to form the movable member.

Also, a method of the present invention for manufacturing a liquid discharge head, which is provided with a discharge port for discharging liquid; a liquid flow path communicated with the discharge port for supplying the liquid to the discharge port; an elemental substrate having a heat generating element provided for one face side thereof for creating bubble in the liquid in the liquid flow path; a liquid flow path side wall formed on the elemental substrate to form the liquid flow path; and a movable member arranged for the elemental substrate, having a free end thereof on the discharge port side with a gap with the elemental substrate in the position facing the heat generating element on the elemental substrate, and a stopper portion to regulate the displacement of the movable member, the free end of the movable member being displaced on the discharge port side centering on the fulcrum structured near the supporting and fixing portion with the elemental substrate by the pressure exerted by the creation of the bubble for discharging the liquid form the discharge port, comprises the steps of arranging the film for the formation of flow path side wall on the movable member on the elemental substrate; and embedding part of liquid flow path and the stopper portion simultaneously on the movable member by etching the film using the pattern different from the liquid flow path pattern in the movable area of the movable member.

In accordance with the methods of manufacture of the present invention described above, it becomes possible to manufacture the liquid discharge head which is capable of directing the exerted pressure toward the discharge ports with the provision of the movable members for the liquid discharge head, which are displaced by the pressure exerted by the creation of bubbles, and also, capable of discharging liquid by the application of high discharge pressure with high discharge energy efficiency, while enhancing the capability of refilling discharge liquid.

Also, silicon is used for the elemental substrate. Then, using silicon material, such as silicon nitride, silicon oxide, or silicon carbide, as the material for the formation of the movable members and the flow path side walls, the thermal expansion coefficients of these members become almost equal. Thus, it becomes possible to prevent strength from becoming weaker for the fixing portion of the movable members with the elemental substrate, as well as for the close contactness between the flow path side walls and the elemental substrate. As a result, it is possible to manufacture the liquid discharge head for which almost no changes are made in the close contactness between the elemental substrate and flow path walls, the positions of the movable members and flow path walls, and also, in the flow resistance of liquid flow paths even when the temperature of the liquid discharge head is caused to change.

Further, the cavitation proof film provided for the elemental substrate is grounded when forming the material film for the formation of movable members and the film for the formation of flow path side walls by use of the plasma CVD method. As a result, it becomes possible to prevent the heat generating elements and other functional elements on the elemental substrate due to the ion seed and radical decomposed by the plasma discharges.

Further, the gap formation members are grounded when forming at least a part of the liquid flow paths and flow path side walls by patterning the material film for the formation of the movable members and the film for the formation of the flow path side walls by use of the dry etching. It becomes possible to prevent damages that may be caused to the heat generating elements 2 and other functional elements on the elemental substrate 1 due to the ion seed and radical loads generated by the decomposition of $CF_4$ gas or other gas, for example.

Also, the liquid discharge head of the present invention is the one that discharges liquid by the utilization of bubbles created when thermal energy is activated on liquid, which is manufactured by the method for manufacturing a liquid discharge head described above.

Further, the head cartridge of the present invention is provided with the liquid discharge head manufactured by the method of manufacture described above, and also, provided with the liquid container that contains liquid to be supplied to this liquid discharge head.

Further, the liquid discharge recording apparatus of the present invention is provided with the liquid discharge head manufactured by the method of manufacture described above, and also, provided with means for supplying driving signals to supply them for discharging liquid from the liquid discharge head.

Further, the liquid discharge recording apparatus of the present invention is provided with the liquid discharge head manufactured by the method of manufacture described above, and also, provided with means for carrying a recording medium to carry the recording medium that receives liquid discharged from the liquid discharge head.

The liquid discharge recording apparatus described above performs recording by discharging liquid from the aforesaid liquid discharge head for the adhesion of the liquid to the recording medium.

The terms "upstream" and "downstream" used for the description of the present invention are related to the flow direction of liquid toward the discharge ports from the supply source of the liquid through the bubble generating areas (or movable members), and these terms are also meant to indicate the structural direction thereof.

Also, the term "downstream side" related to the bubble itself means the downstream side of the center of a bubble in the aforesaid flow direction and the aforesaid structural direction or this term means the bubble created on the downstream side area of the area center of a heat generating element. Likewise, the term "upstream side" related to the bubble itself means the upstream side of the center of a bubble in the aforesaid flow direction and the aforesaid structural direction or it means a bubble created on the upstream side area of the area center of a heat generating element.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Now, hereinafter, with reference to the accompanying drawings, the description will be made of the embodiments in accordance with the present invention.

First Embodiment

Figure 1:
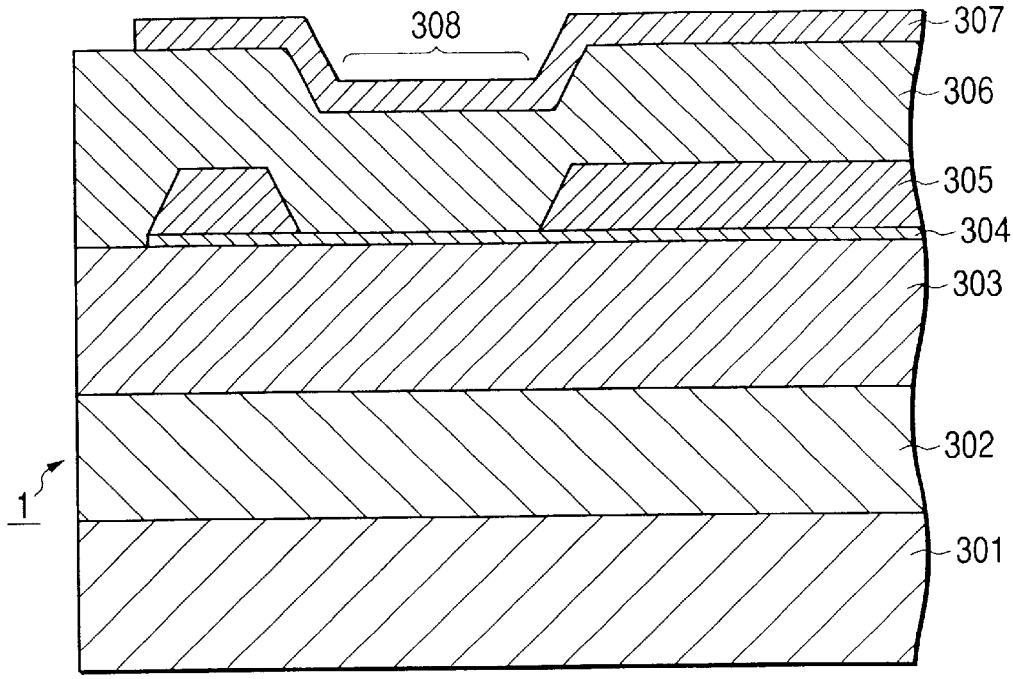
FIG. 1 is a cross-sectional view which shows the elemental substrate used for the liquid discharge head in accordance with a first embodiment of the present invention.

FIG. 1 is a cross-sectional view which shows the elemental substrate used for the liquid discharge head in accordance with a first embodiment of the present invention. As shown in FIG. 1, for the elemental substrate 1 used for the liquid discharge head of the present embodiment, there are laminated on the surface of the silicon substrate 301 the thermal oxidation film 302 serving as the heat accumulation layer, and the interlayer film 303 which dually serves as the heat accumulation layer in that order. For the interlayer film 303, $SiO_2$ film or $Si_3N_4$ film is used. On the surface of the interlayer film 303, the resistive layer 304 is formed locally, and on the surface of the resistive layer 304, the wiring 305 is formed locally. As the wiring 305, Al or Al alloy wiring, such as Al—Si or Al—Cu, is used. On the surface of the wiring 305, the resistive layer 304, and the interlayer 303, the protection film 306 of $SiO_2$ or $Si_3N_4$ film is formed. On the portion of the surface of the protection film 306 which corresponds to the resistive layer 304 and the circumference thereof, the cavitation proof film 307 is formed to protect the protection film 306 from the chemical and physical shocks that follow the heating of the resistive layer 304. The surface of the resistive layer 304 where no wiring 305 formed is the heat activating portion 308 which is the portion where heat of the resistive layer 304 is activated.

The films on the elemental substrate 1 are formed sequentially on the surface of the silicon substrate 301 by the application of the semiconductor manufacturing technologies and techniques. Then, the heat activating portion 308 is provided for the silicon substrate 301.

Figure 2:
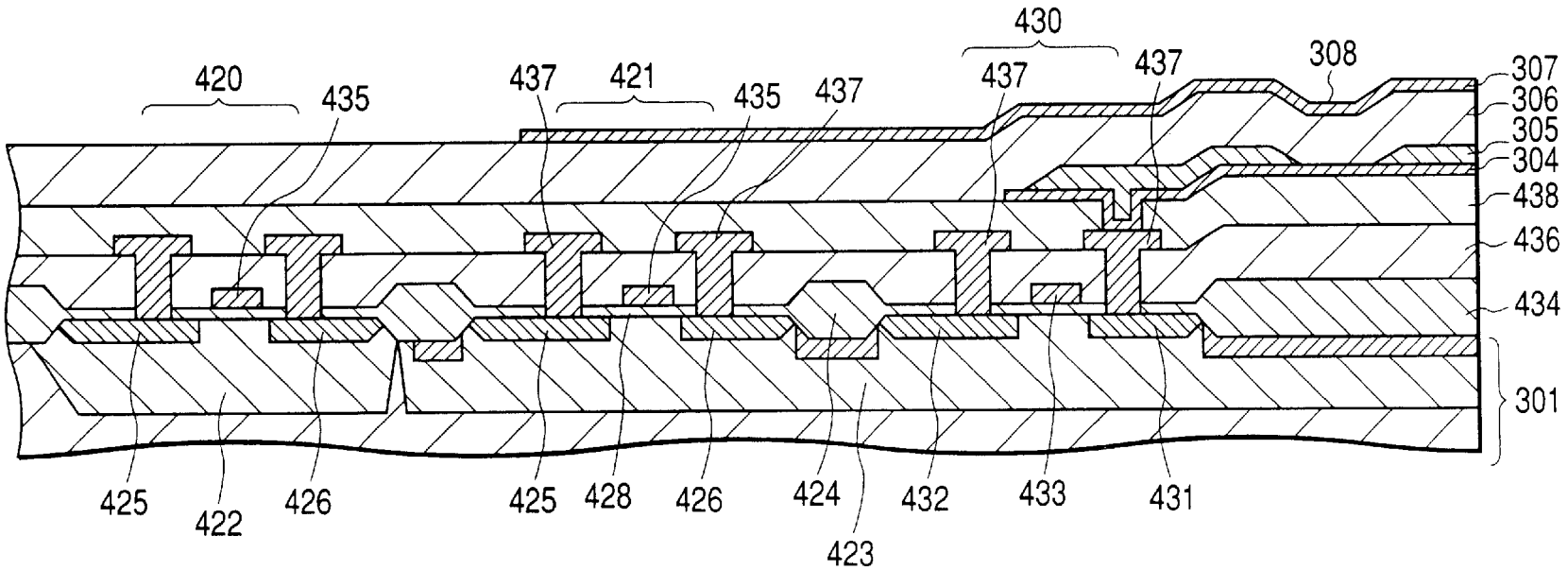
FIG. 2 is a schematic cross-sectional view which shows the elemental substrate, taken vertically through the principal element of the elemental substrate represented in FIG. 1.

FIG. 2 is a schematic cross-sectional view which shows the elemental substrate 1 taken vertically through the principal element of the elemental substrate 1 represented in FIG. 1.

As shown in FIG. 2, on the surface layer of the silicon substrate 301 which is the P conductor, the N type well region 422 and the P type well region 423 are locally arranged. Then, by use of the general MOS process, the ion plantation or some other impurity plantation and diffusion are carried out to provide the P-MOS 420 for the N type well region 422, and the N-MOS 421 for the P type well region 423. The P-MOS 420 comprises the source region 425 and the drain region 426, which are formed by introducing the N type or the P type impurities into the surface layer of the N type well region 422 locally, and the gate wiring 435 or the like deposited on the surface of the N type well region 422 with the exception of the source region 425 and the drain region 426 through the gate insulation film 428 formed in a thickness of several hundredth of Å. Also, the N-MOS 421 comprises the source region 425 and the drain region 426, which are formed by introducing the N type or the P type impurities into the surface layer of the P type well region 423 locally, and the gate wiring 435 or the like deposited on the surface of the P type well region 423 with the exception of the source region 425 and the drain region 426 through the gate insulation film 428 formed in a thickness of several hundredth of Å. The gate wiring 435 is formed by polysilicon deposited by the CVD method in a thickness of 4000 Å to 5000 Å. These P-MOS 420 and N-MOS 421 constitute the C-MOS logic.

On the portion of the P type well region 423 which is different from the N-MOS 421, the N-MOS transistor 430 is provided for use of driving the electrothermal transducing elements. The N-MOS transistor 430 also comprises the source region 432 and the drain region 431 which are locally arranged on the surface layer of the P type well region 423 by the processes of the impurity plantation and diffusion or the like, and the gate wiring 433 deposited on the surface of the P type well region 423 with the exception of the source region 432 and the drain region 431 through the gate insulation film 428.

In accordance with the present embodiment, the N-MOS transistor 430 is used as the transistor for use of driving the electrothermal transducing elements, but the transistor is not necessarily limited to this type. Any type should be adoptable if only such transistor is capable of driving a plurality of electrothermal transducing elements individually, and also, capable of providing such fine structure as described above.

Between each of the elements, such as between the P-MOS 420 and the N-MOS 421, between the N-MOS 421 and the N-MOS transistor 430 or the like, the oxidation film separation region 424 is formed by the application of the field oxidation in a thickness of 5000 Å to 10000 Å. Then, the respective elements are separated by the presence of the oxidation film separation region 424. The portion of the oxidation film separation region 424 that corresponds to the heat activating portion 308 is arranged to function as the first layer heat accumulation layer 434 when observed from the surface side of the silicon substrate 301.

For the surface of each element of the P-MOS 420, the N-MOS 421, and the N-MOS transistor 430, the interlayer insulation film 436 is formed by the CVD method with PSG film, BPSG film, or the like in a thickness of approximately 7000 Å. After the interlayer insulation film 436 is smoothed by the application of heat treatment, the wiring is performed by the Al electrode 437 which becomes the first wiring layer through the contact hole that penetrates the interlayer insulation film 436 and the gate insulating film 428. On the surface of the interlayer insulation film 436 and the Al electrode 437, the interlayer insulation film 438 is formed by the plasma CVD method with $SiO_2$ film in a thickness of 10000 Å to 15000 Å. On the surface of the portion of the interlayer insulation film 438 which corresponds to the heat activating portion 308 and the N-MOS transistor 430, the resistive layer 304 is formed by the DC sputtering method with $TaN_{0.8,hex}$ in a thickness of approximately 1000 Å. The resistive layer 304 is electrically connected with the Al electrode 437 in the vicinity of the drain region 431 by way of the through hole formed on the interlayer insulation film 438. On the surface of the resistive layer 304, the Al wiring 305 is formed as the second wiring layer that serves as the wiring to each of the electrothermal transducing elements.

The protection film 306 on the surface of the wiring 305, the resistive layer 304, and the interlayer insulation film 438 is formed by the plasm CVD method with $Si_3N_4$ film in a thickness of 10000 Å. The cavitation proof film 307 formed on the surface of the protection film 306 is formed with Ta or the like in a thickness of approximately 2500 Å.

Figure 3:
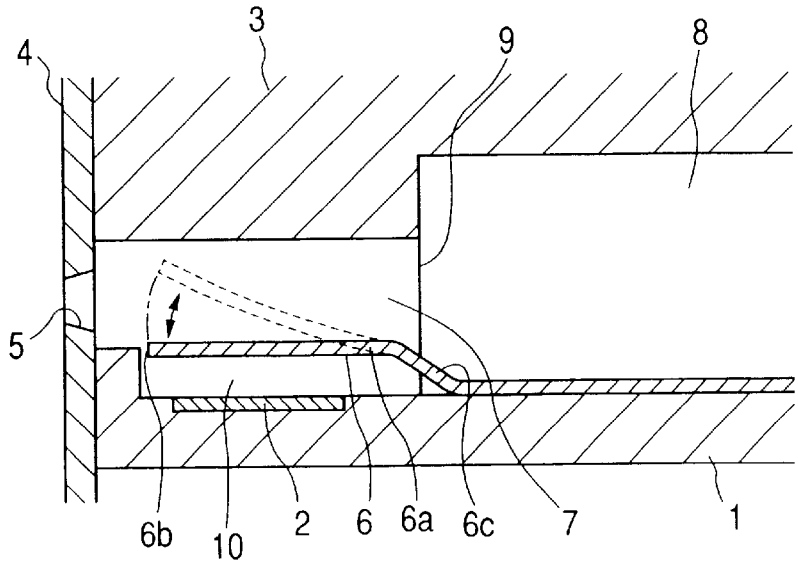
FIG. 3 is a cross-sectional view of the liquid discharge head in accordance with the first embodiment of the present invention, taken in the flow path direction.

FIG. 3 is a cross-sectional view which shows the liquid discharge head in accordance with the first embodiment of the present invention, taken in the flow path direction.

As shown in FIG. 3, the liquid discharge head of the present embodiment comprises the elemental substrate 1 having a plurality of heat generating elements 2 (only one is shown in FIG. 3) arranged in parallel which serve as the discharge energy generating elements to give thermal energy for the creation of bubbles in liquid; the ceiling plate 3 bonded to this elemental substrate 1; and the orifice plate 4 bonded to the front end of the elemental substrate 1 and the ceiling plate 3.

As described above, the elemental substrate 1 is formed in such a manner that the silicon film or silicon nitride film is formed on the silicon substrate or the like for the purpose of insulation and heat accumulation, and that the electric resistance layer and wiring, which constitute each of the heat generating elements 2, are patterned on the substrate. With voltage applied to the electric resistance layer through the wiring so that current runs through the electric resistance layer, each of the heat generating elements 2 is energized to generate heat. Then, on the wiring and the electrode resistive layer, the protection film is formed to protect them from ink. Further, on the protection film, the cavitation proof film is formed to protect it from the cavitation due to defoaming of ink. On the elemental substrate 1, there are formed flow path walls 9 to form a plurality of liquid flow paths 7 corresponding to each of the heat generating elements 2, and the member that constitutes the common liquid chamber 8 from which liquid is supplied to each of the liquid flow paths 7.

The ceiling plate 3 is also the one which constitutes a plurality of liquid flow paths 7 corresponding to each of the heat generating elements 2, and the common liquid chamber 8 for supplying liquid to each of the liquid flow paths 7. The ceiling plate 3 is formed by silicon material, and produced by depositing silicon oxide on the silicon substrate by the known film formation method, such as the CVD.

On the orifice plate 4, there are formed a plurality of discharge ports 5 arranged to correspond to each of the liquid flow paths 7, which are communicated with the common liquid chamber 8 through each of the liquid flow paths 7. With the elemental substrate 1 and the ceiling plate 3 being bonded together, the head substrate is structured with a plurality of heat generating elements 2 and liquid flow paths 7. Then, to the front end of the head substrate, the orifice plate 4 is bonded.

On the portion of the elemental substrate 1 that corresponds to the liquid flow path 7, the plate type movable member 6 is arranged in a cantilever fashion with the flat portion that faces the heat generating element 2. The movable member 6 is formed by an elastic material. The stepping portion **6*c* is arranged on one end of the movable member 6 arranged in the cantilever fashion. Then, the movable member 6 is directly fixed onto the elemental substrate 1. In this way, the movable member 6 is held on the elemental substrate 1, thus forming the fulcrum 6*a* of the movable member 6, and the free end 6*b* on the downstream side with respect to the fulcrum 6*a***.

The movable member 6 is arranged in a position to face the heat generating element 2 to cover the heat generating element 2 with a gap of a specific distant to the heat generating element 2 so that the fulcrum **6*a* of the movable member 6 is arranged on the upstream side in the large flow running by the operation of the liquid discharge from the common liquid chamber 8 to the discharge port 5 side through above the movable member 6, and the free end 6*b* is arranged on the downstream side with respect to the fulcrum 6*a*. The space between the heat generating element 2 and the movable member 6 becomes each of the bubble generating area 10. As the material of the movable member 6**, silicon nitride, silicon oxide, silicon carbide, or the like is used.

Figure 4:
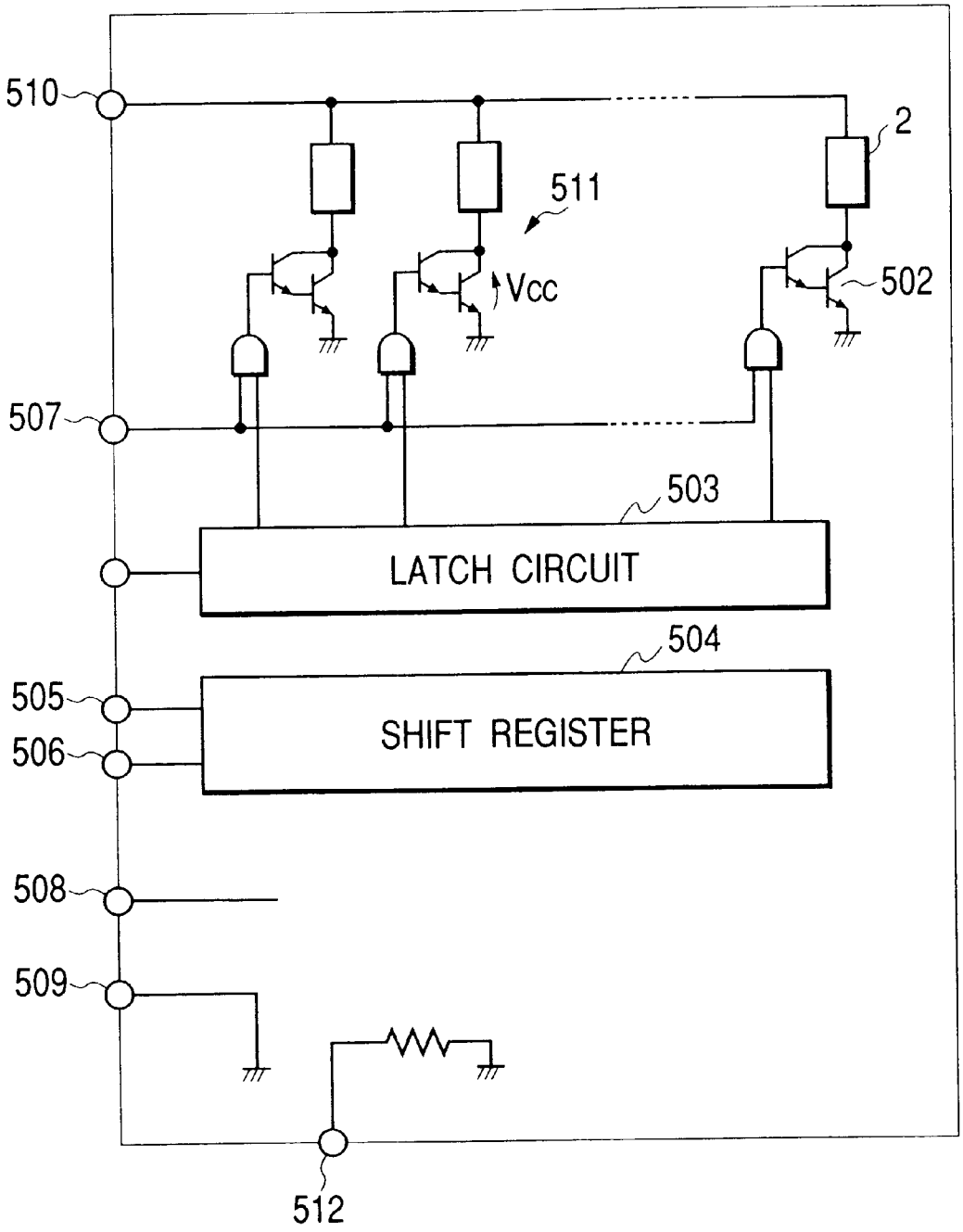
FIG. 4 is a view which illustrates the circuit structure of the elemental substrate 1 shown in FIG. 1, FIG. 2, and FIG. 3.

FIG. 4 is a view which illustrates the circuit structure of the elemental substrate 1 represented in FIG. 1, FIG. 2, and FIG. 3. In FIG. 4, a reference numeral 2 designates the heat generating elements arranged in one line; 502, the power transistor serving as the driver; 503, latch circuits; and 504, shift registers. Also, a reference numeral 505 designates the clock that gives motion to the shift registers 504; 506, the image data input unit; 507, the heat pulse width input unit to control the on-time of the power transistor 502 externally; 508, the logic power supply; 509, the GND; 510, the heat generating element driving power source (VH); 511, the power transistor (Vce); and 512, the cavitation proof film formed on the elemental substrate 1. The cavitation proof film 512 is electrically connected with the silicon substrate that constitutes the elemental substrate 1. In this way, as described later, the cavitation proof film 512 is grounded to the earth through the silicon substrate of the elemental substrate 1 when the SiN film is formed on the elemental substrate 1 by the plasma CVD method for manufacturing the liquid discharge head or when the SiN film is removed from the elemental substrate 1 by use of the dry etching.

For the liquid discharge recording apparatus provided with the liquid discharge head having the elemental substrate 1 thus formed therefor, the image data are inputted from the image data input unit 506 to the shift registers 504 serially. The input data are provisionally stored on the latch circuit 503. Then, during such period, when pulses are inputted from the heat pulse width input unit 507, the power transistor 502 is turned on to drive the respective heat generating elements 2. In this way, liquid (ink) on the heat generating element 2 thus driven in the liquid flow path is heated, thus discharging liquid from the corresponding discharge port for recording.

Now, the description will be made of the method for manufacturing the liquid discharge head shown in FIG. 3.

Figure 5A:
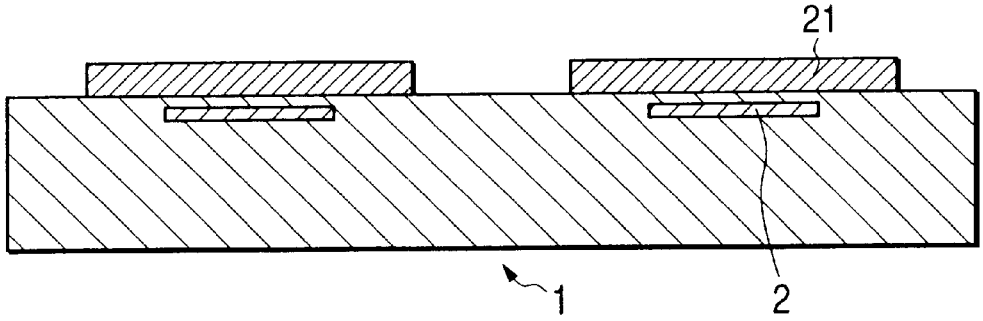
FIGS. 5A, 5B and 5C are views which illustrate the method for forming the movable members and flow path side walls on the elemental substrate shown in FIG. 3.
Figure 5B:
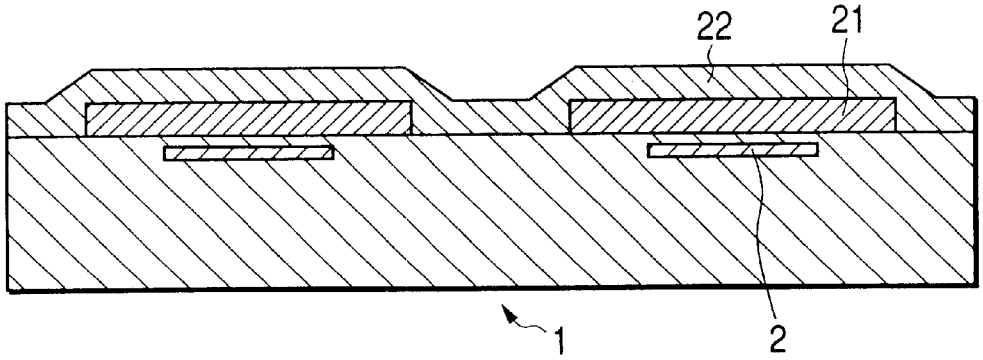
Figure 5C:
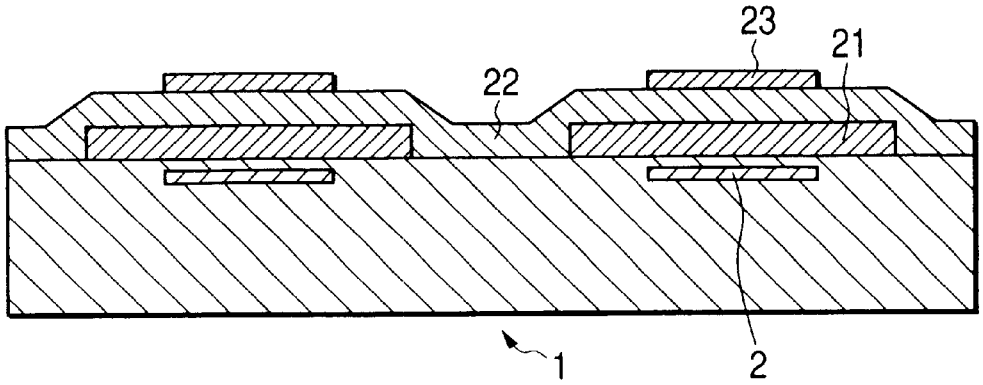
Figure 6:
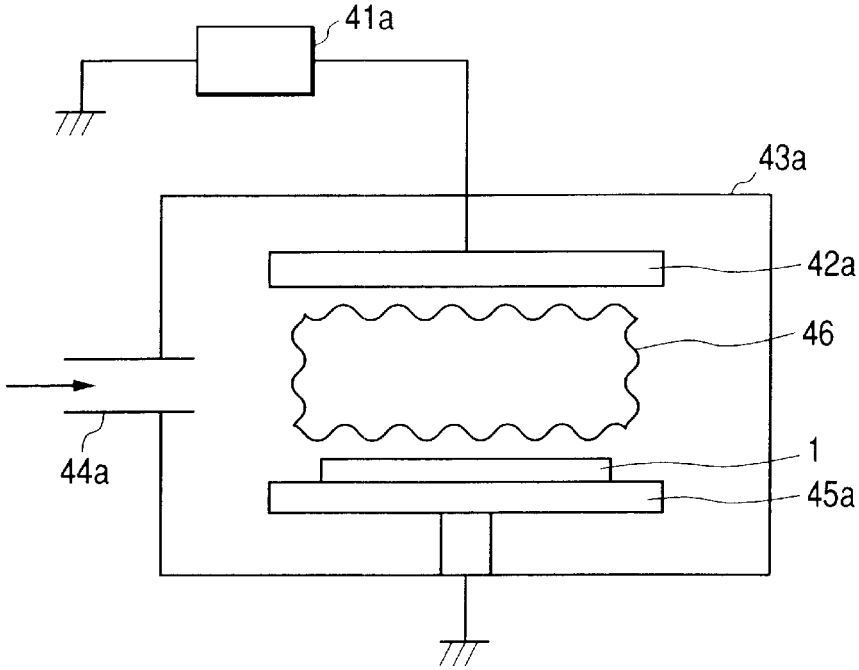
FIG. 6 is a view which illustrates the method for forming the SiN film on the elemental substrate 1 by use of the plasma CVD apparatus.
Figure 8:
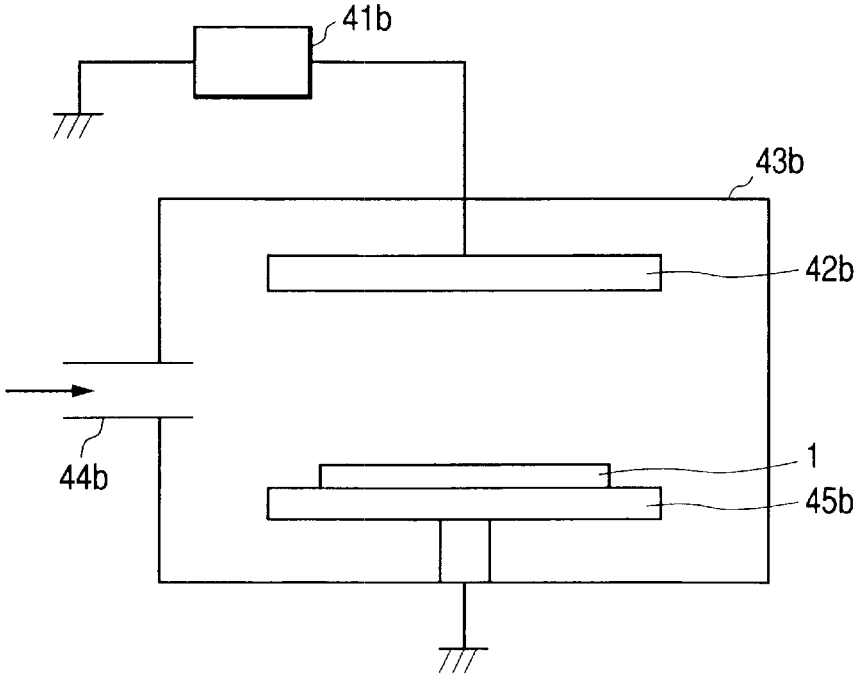
FIG. 8 is a view which illustrates the method for etching the SiN film by use of the dry etching apparatus.
Figure 7A:
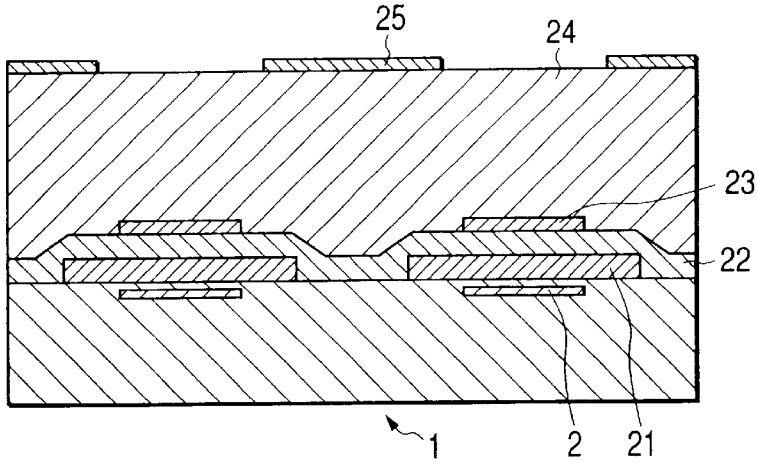
FIGS. 7A, 7B and 7C are views which illustrate the method for forming the movable members and flow path side walls on the elemental substrate shown in FIG. 3.
Figure 7B:
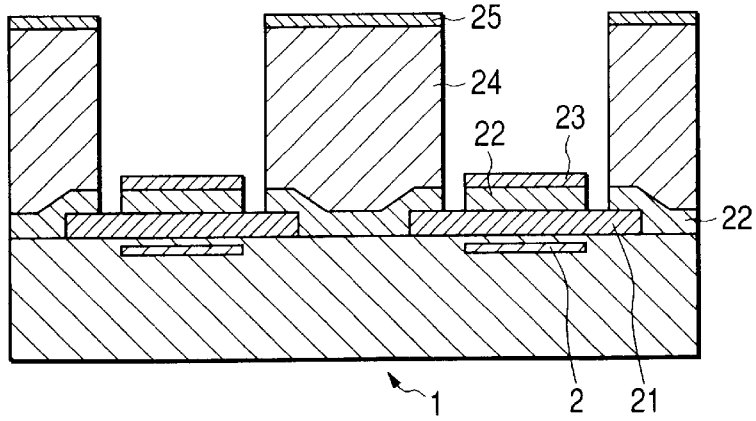
Figure 7C:
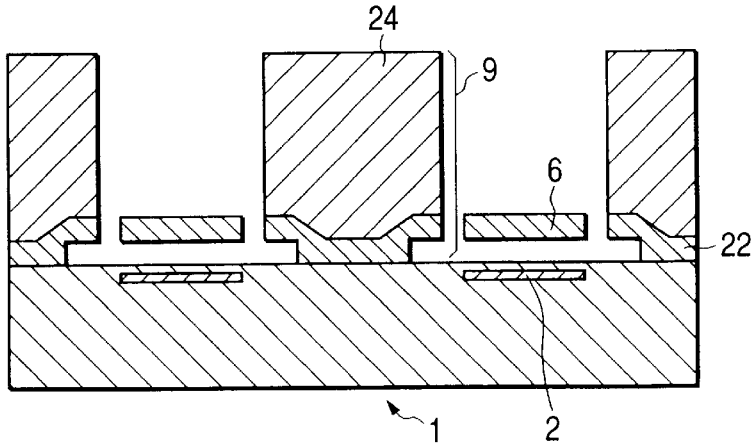

Now, FIGS. 5A to 5C are views which illustrate the method for forming the movable members 6 and flow path side walls 9 on the elemental substrate 1 shown in FIG. 3. FIG. 6 is a view which illustrates the method for forming the SiN film on the elemental substrate 1 by use of the plasma CVD apparatus. FIGS. 7A to 7C are views which illustrate the method for forming the movable members 6 and flow path side walls 9 on the elemental substrate 1 shown in FIG. 3. FIG. 8 is a view which illustrates the method for etching the SiN film by use of the dry etching apparatus. Each of FIGS. 5A to 5C and FIGS. 7A to 7C shows the section of each liquid flow path 7 represented in FIG. 3 in the direction orthogonal to the flow direction thereof. Then, the movable members 6 and the flow path walls 9 are formed on the elemental substrate 1 through the processes shown in FIGS. 5A to 5C and FIGS. 7A to 7C.

At first, in FIG. 5A, TiW film (not shown) is formed by the sputtering method on the entire surface of the elemental substrate 1 on the heat generating element 2 side in a thickness of approximately 5000 Å as the first protection layer to protect the connecting pad portions to be electrically connected with the heat generating elements 2. On the surface of the elemental substrate 1 on the heat generating element 2 side, the Al film is formed by the sputtering method in a thickness of approximately 4 μm for the provision of the gap formation members 21. The Al film thus formed is patterned by use of the known photolithographic process. Then, a plurality of the gap formation members 21 of the Al film are formed in each position that faces the bubble generating area 10 between the heat generating element 2 and the movable member 6 shown in FIG. 3 in order to form the gaps between the elemental substrate 1 and the movable members 6, respectively. Each of the gap formation members 21 is extended up to the area where the etching is made on the SiN film 22 which is the film material for the formation of the movable members 6 in the process shown in FIG. 7B to be described later.

The gap formation member 21 functions as the etching stop layer when the liquid flow paths 7 and the movable members 6 are formed by the dry etching which will be described later. The TiW layer that serves as the pad protection layer on the elemental substrate 1, the Ta film that serves as the cavitation proof film, and the SiN film that serves as the protection layer on the resistive elements are subjected to be etched by use of etching gas at the time of forming the liquid flow paths 7. Therefore, with the provision of the gap formation members 21, these layers and films are prevented from being etched. For this purpose, each width of the gap formation members 21 is made wider in the direction orthogonal to the flow path direction of the liquid flow paths 7 than the width of each liquid flow paths 7, which is formed in the process shown in FIG. 7B to be described later, so that the surface of the elemental substrate 1 on the heat generating element 2 side and the TiW layer on the elemental substrate 1 are not allowed to be exposed when the liquid flow paths 7 are formed by use of the dry etching.

Further, when the dry etching is performed, the $CF_4$ gas is decomposed to generate the ion seed and radical which may damage the heat generating elements 2 and functional elements on the elemental substrate 1. However, the gap formation member 21 formed by Al catches the ion seed and radical to protect the heat generating elements 2 and the functional elements on the elemental substrate 1.

Now, in FIG. 5B, the SiN film 22, which is the material used for the formation of the movable members 6, is formed by the plasma CVD method in a thickness of approximately 4.5 μm on the surface of the gap formation members 21 and the surface of the elemental substrate 1 on the gap formation member 21 side to cover the gap formation members 21. Here, when the SiN film 22 is formed by use of the plasma CVD apparatus, the cavitation proof of Ta provided for the elemental substrate 1 is grounded through the silicon substrate and others that constitute the elemental substrate 1 as described with reference to FIG. 6 next. In this manner, it becomes possible to protect the heat generating elements 2 and the latch circuits and other functional elements on the elemental substrate 1 from the loads caused by the ion seed and radical decomposed by the plasmic discharges in the reaction chamber of the plasma CVD apparatus.

As shown in FIG. 6, in the reaction chamber 43*a* of the plasma CVD apparatus used for the formation of the SiN film 22, the RF electrodes 42*a* and the stage 45*a* are arranged to face each other with a specific distance. To the RF electrodes 42*a*, voltage is applied from the RF supply source 41*a* arranged outside the reaction chamber 43*a*. On the other hand, on the surface of the stage 45*a* on the RF electrode 42*a* side, the elemental substrate 1 is installed so that the surface of the elemental substrate 1 on the heat generating element 2 side faces the RF electrodes 42*a*. Here, the cavitation proof film of Ta formed on each surface of the heat generating elements 2 on the elemental substrate 1 is connected with the silicon substrate of the elemental substrate 1 as described earlier in conjunction with FIG. 4. Thus, the gap formation members 21 are grounded through the silicon substrate of the elemental substrate 1 and the stage 45*a*.

For the plasma CVD apparatus thus structured, gas is supplied to the reaction chamber 43*a* through the supply tube 44*a* in the state where the cavitation proof film is grounded. Then, plasma 46 is generated between the elemental substrate 1 and the RF electrodes 42*a*. The ion seed and radical decomposed by the plasmic discharges in the reaction chamber 43*a* are deposited on the elemental substrate 1 so that the SiN film 22 is formed on the elemental substrate 1. At this juncture, the loads are generated by the ion seed and radical on the elemental substrate 1, but with the cavitation proof film being grounded, it is possible to prevent the heat generating elements 2, the latch circuits and other functional elements on the elemental substrate 1 from being damaged by the loads caused by the iron seed and radical.

Now, in FIG. 5C, the Al film is formed by the sputtering method on the surface of the SiN film 22 in a thickness of approximately 6100 Å. After that, the Al film thus formed is patterned by the known process of photolithography so as to allow the Al film 23 to be left intact as the second protection layer on the surface portion of the SiN film 22 which corresponds to the movable members 6, that is, the movable member formation area on the surface of the SiN film 22. The Al film 23 becomes the protection layer (etching stop layer) when the liquid flow paths 7 are formed by use of the dry etching.

Now, in FIG. 7A, the SiN film 24 used for the formation of the flow path walls 9 is formed by the microwave CVD method on the surface of the SiN film 22 and the Al film 23 in a thickness of approximately 50 $\mu$m. Here, as the gas which is used for the SiN film 24 formation by the microwave CVD method, monosilane ($SiH_4$), nitrogen ($N_2$), and argon (Ar) are used. As the combination thereof, it may be possible to use disilane ($Si_2H_6$), ammonium ($NH_3$), or the like besides those mentioned above or use them as a mixed gas. Also, with the microwave power of 1.5 [kW] at the frequency of 2.45 [GHz], the SiN film 24 is formed under high vacuum pressure of 5 [mTorr] with each of gasses at the gas flow rate of 100 [sccm] monosilane, 100 [sccm] nitrogen, and 40 [sccm] argon, respectively. Here, it may be possible to form the SiN film 24 by the microwave CVD method or the CVD method using the RF power supply in the gas composition ratio other than the one mentioned above.

When the SiN film 24 is formed by the CVD method, the Ta cavitation proof film formed on the surface of the heat generating elements 2 is grounded through the silicon substrate of the elemental substrate 1 as the same method described earlier for the formation of the SiN film 22 in conjunction with FIG. 6. In this way, the heat generating elements 2, the latch circuits and other functional elements on the elemental substrate 1 are protected from the loads caused by the ion seed and radical decomposed by the plasmic discharges in the reaction chamber of the CVD apparatus.

Then, after the Al film is formed on the entire surface of the SiN film 24, the Al film thus formed is patterned by the known method of photolithography or the like to form the Al film 25 on the portion of the surface of the SiN film 24 with the exception of the portion corresponding to the liquid flow paths 7. As described earlier, the width of each of the gap formation members 21 in the direction orthogonal to the flow path direction of the liquid flow paths 7 is made wider than the width of each liquid flow path 7 to be formed in the next process shown in FIG. 7B. Therefore, the side portion of the Al film 25 is arranged above the side portion of the gap formation member 21.

Then, in FIG. 7B, the SiN film 24 and the SiN film 22 are patterned by use of the etching apparatus that adopts dielectric coupling plasm, thus forming the flow path walls 9 and the movable members 6 at the same time. This etching apparatus uses a mixed gas of $CF_4$ and $O_2$ for etching the SiN film 24 and the SiN film 22 with the Al films 23 and 25, and the gap formation members 21 being used as the etching stop layer, that is, used as the mask so that the SiN film 24 presents its trench structure. In this patterning process for the SiN film 22, the unwanted portion of the SiN film 22 is removed so that as shown in FIG. 3, each supporting portion of the movable members 6 is directly fixed to the elemental substrate 1. The structural material used for the close contact portion between each fixed supporting portion of the movable members 6 and the elemental substrate 1 contains the TiW which is the structural material of the pad protection layer, and the Ta which is the structural material of the cavitation proof film provided for the elemental substrate 1.

Here, when the SiN film 22 and the SiN film 24 are etched by use of the dry etching apparatus, the gap formation members 21 are grounded through the elemental substrate 1 or the like as described next with reference to FIG. 8. Then, it becomes possible to prevent the ion seed and radical loads generated by the decomposition of the $CF_4$ gas at the time of dry etching from being stagnated on the gap formation members 21, hence protecting the heat generating elements 2, the latch circuits and other functional elements on the elemental substrate 1. Also, since each width of the gap formation members 21 is made wider than the width of each liquid flow path 7 formed in this etching process, the surface of the elemental substrate 1 on the heat generating element 2 side is not allowed to be exposed when the unwanted portion of the SiN film 24 is removed. Thus, the gap formation members 21 reliably protect the elemental substrate 1.

As shown in FIG. 8, in the reaction chamber 43*b* of the dry etching apparatus used for etching the SiN films 22 and 24, the RF electrodes 42*b* and the stage 45*b* are arranged to face each other with a specific distance. To the RF electrodes 42*b*, voltage is applied from the RF supply source 41*b* arranged outside the reaction chamber 43*b*. On the other hand, on the surface of the stage 45*b* on the RF electrode 42*b* side, the elemental substrate 1 is installed so that the surface of the elemental substrate 1 on the heat generating element 2 side faces the RF electrodes 42*b*. Here, the gap formation members 21 formed by the Al film is electrically connected with the Ta cavitation proof film provided for the elemental substrate 1, and then, the cavitation proof film is electrically connected with the silicon substrate of the elemental substrate 1 as described earlier in conjunction with FIG. 4. Thus, the gap formation members 21 are grounded through the cavitation proof film and the silicon substrate of the elemental substrate 1, as well as through the stage 45*b*.

For the dry etching apparatus thus structured, a mixed gas of $CF_4$ and $O_2$ is supplied to the reaction chamber 43*a* through the supply tube 44*a* in the state where the gap formation members 21 are grounded for etching the SiN films 24 and 22. At this juncture, the ion seed and radical loads are generated on the elemental substrate 1 due to the decomposition of the $CF_4$ gas, but as described above, with the gap formation members 21 being grounded, it is possible to prevent the heat generating elements 2, the latch circuits and other functional elements on the elemental substrate 1 from being damaged by the iron seed and radical loads.

For the present embodiment, the mixed gas of $CF_4$ and $O_2$ is used as the gas to be supplied to the interior of the reaction chamber 43*a*. However, it may be possible to use the $CF_4$ gas without the $O_2$ gas mixed or to use $C_2F_6$ gas or a mixed gas of $C_2F_6$ and $O_2$.

Now, in FIG. 7C, using a mixed acid of acetic acid, phosphoric acid, and nitric acid the Al films 23 and 25 are hot etched to elute the Al films 23 and 25, and the gap formation members 21 formed by the Al film for the removal thereof. Then, the movable members 6 and the flow path side walls 9 are embedded in the elemental substrate 1. After that, the portion of the TiW film serving as the pad protection layer formed on the elemental substrate 1, which corresponds to the bubble generating areas 10 and pads, is removed by use of hydrogen peroxide. The portion that closely connects the elemental substrate 1 and the flow path side walls 9 also contains the TiW which is the structural material of the pad protection layer, and the Ta which is the structural material of the cavitation proof film provided for the elemental substrate 1.

Figure 9:
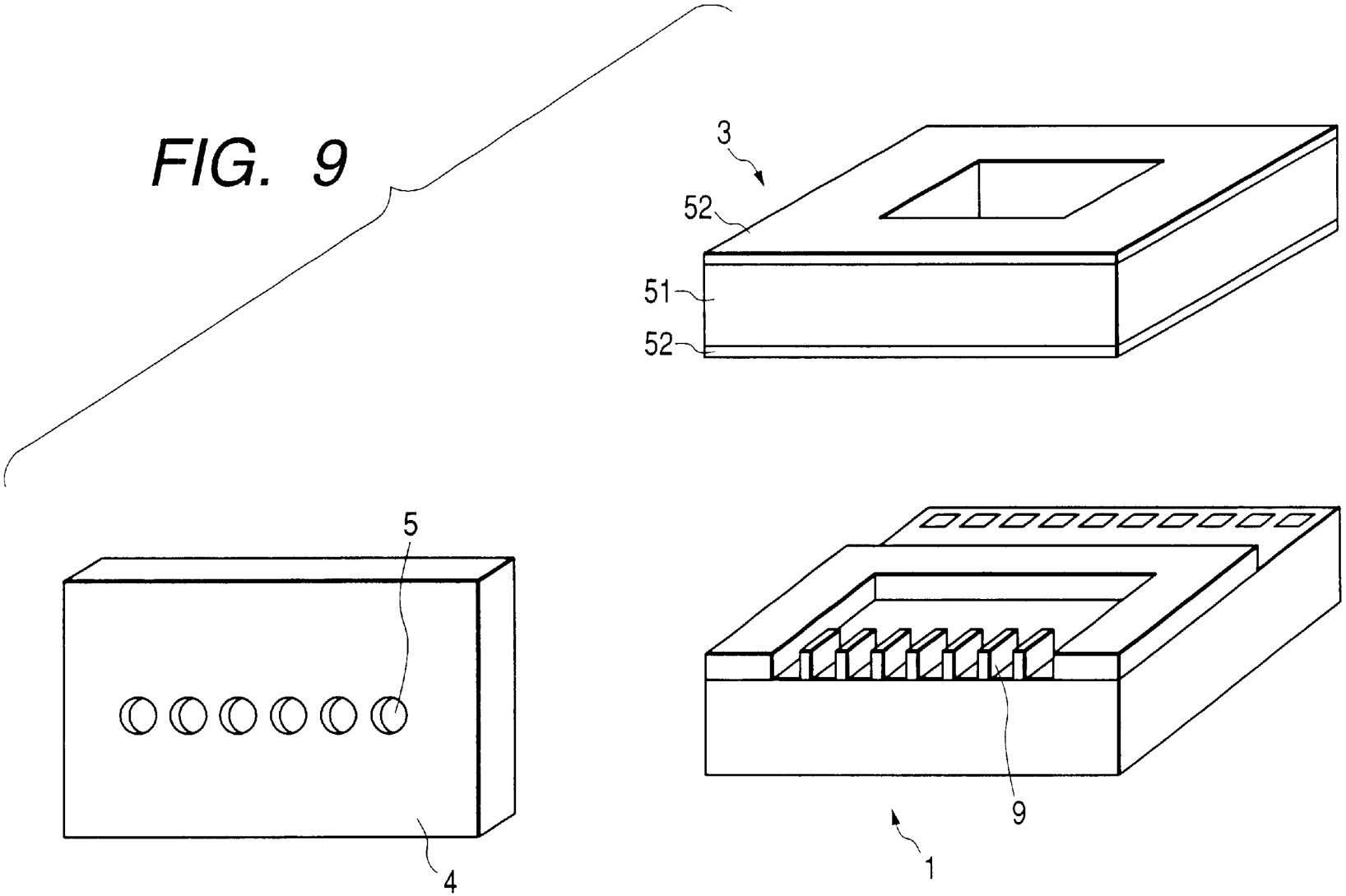
FIG. 9 is a view which illustrates the method for manufacturing the liquid discharge head shown in FIG. 3 in accordance with the present embodiment.

FIG. 9 is a view which illustrates the method for manufacturing the liquid discharge head of the present embodiment shown in FIG. 3.

Subsequent to having formed the movable member 6 and the flow path side walls 9 on the elemental substrate 1 as described above, the ceiling plate 3 is bonded to the surface of the elemental substrate 1 on the flow path side wall 9 side, and at the same time, the orifice plate 4 having the discharge ports 5 formed therefor is bonded to the front end of the elemental substrate 1 and the ceiling plate 3 as shown in FIG. 9, hence manufacturing the liquid discharge head shown in FIG. 3. The ceiling plate 3 is produced by forming the $SiO_2$ film 52 on both faces of the silicon wafer 51. As the method for producing the ceiling plate 3, the $SiO_2$ film 52 is formed on both faces of the silicon wafer 51, and then, by use of the known photolithographic process, the $SiO_2$ film 52 is patterned. After that, the portion of the silicon wafer 51 that corresponds to the common liquid chamber 8 is removed by etching with TMAH (tetra methyl ammonium hydride), thus forming the common liquid chamber 8 on the ceiling plate 3 in order to supply ink to the liquid flow paths 7.

For the method of the present embodiment for manufacturing the liquid discharge head, the description has been made of the case where the supporting and fixing portion of the movable members 6 is directly fixed onto the elemental substrate 1 as shown in FIG. 3. However, it may be possible to manufacture the liquid discharge head having the movable members fixed to the elemental substrate through pedestal portions with the application of the method of the present embodiment for manufacturing the liquid discharge head. In this case, prior to the process in which the gap formation members 21 are formed as shown in FIG. 5A, the pedestal portions, which fix on the elemental substrate the end portion of each movable member on the side opposite to its free end, are formed for the elemental substrate on the heat generating element side. In this case, too, the structural material of the portion where the pedestals and the elemental substrate are closely connected contains the TiW which is the structural material of the pad protection layer, and the Ta which is the structural material of the cavitation proof film provided for the elemental substrate.

As described above, in accordance with the present embodiment, the method for manufacturing the liquid discharge head makes it possible to the liquid discharge head capable of discharging liquid at high discharging pressure with high discharge energy efficiency with the provision of the movable members 6 for the liquid discharge head, which are displaceable by the pressure exerted by the creation of bubbles, because the pressure thus exerted can be directed toward the discharge ports efficiently, while enhancing the capability of refilling the discharge liquid.

Also, by use of silicon as the material of the elemental substrate 1, and also, by use of silicon material, such as silicon nitride, silicon oxide, silicon carbide, for the movable members 6 and the flow path side walls 9, thermal expansion ratio of these members become almost equal. Therefore, it becomes possible to prevent the strength of the fixing portion of the movable members 6 with respect to the elemental substrate 1, as well as the close contactness between the flow path side walls 9 and the elemental substrate 1, from being made weaker or lower by the temperature changes. As a result, it becomes possible to manufacture the liquid discharge head capable of keeping the close contactness between the elemental substrate 1 and the flow path walls 9, the positions of the movable members 6 and the flow path side walls 9 with respect to the heat generating elements 2, as well as the flow resistance to the liquid flow paths 7, in a state where each of them is almost unchanged even if the temperature of the liquid discharge head changes. Further, by use of the photolithographic process to form the movable members, it becomes possible to minimize the fluctuation of the mechanical characteristics of the movable members due to the dimensional variation of thereof, such as its length and width in the discharge direction. Also, the movable members 6 and the flow path side walls 9 can be formed in higher precision and higher density.

In accordance with the present embodiment, the movables members 6 and the flow path side walls 9 are formed on the elemental substrate 1, and then, the ceiling plate is bonded thereto. However, it may be possible to manufacture the liquid discharge head by the method of manufacture which differs from the one described above, such as a method for manufacturing a liquid discharge head to be described hereunder.

FIGS. 10A to 10E are views which illustrate the variational example of the method for manufacturing the liquid discharge head described in conjunction with FIGS. 5A to 5C and FIGS. 7A to 7C. FIGS. 10A to 10E are cross-sectional views-taken in the flow path direction of the liquid flow path 7 shown in FIG. 3. In accordance with the method for manufacturing the liquid discharge head to be described in conjunction with FIGS. 10A to 10E, the elemental substrate 1 with the movable members 6 formed thereon, and the ceiling plate with the flow path side walls formed thereon are bonded together to produce the liquid discharge head whose structure is as shown in FIG. 3. Therefore, in accordance with this method of manufacture, the flow path walls are incorporated in the ceiling plate before the elemental substrate 1 having the movable members 6 embedded therein is bonded to the ceiling plate.

Figure 10A:
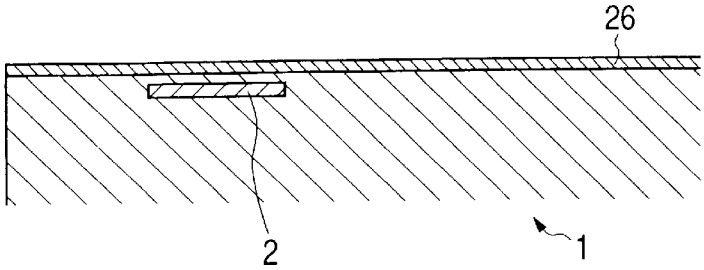
FIGS. 10A, 10B, 10C, 10D and 10E are views which illustrate the variational example of the method for manufacturing the liquid discharge head described in conjunction with FIGS. 5A to 5C and FIGS. 7A to 7C.

At first, in FIG. 10A, the TiW film 26 is formed by the sputtering method on the entire surface of the elemental substrate 1 on the heat generating element 2 side in a thickness of approximately 5000 Å as the first protection layer to protect the connecting pad portions to be electrically connected with the heat generating elements 2.

Figure 10B:
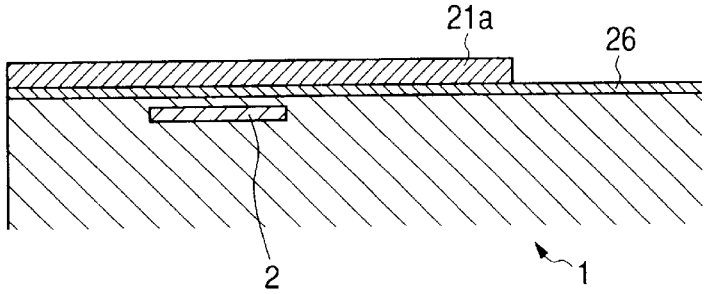

Then, in FIG. 10B, the Al film is formed on the TiW film 26 by the sputtering method in a thickness of approximately 4 $\mu$m for the provision of the gap formation member 21*a*. The gap formation member 21*a* is extended to the area where the SiN film 22*a* is etched in the process to be described in conjunction with FIG. 10D.

The Al film thus formed is patterned by use of the known photolithographic process. Then, the gap formation member 21*a* is formed on the surface of the TiW film 26 after having removed only the portion of the Al film that corresponds the supporting and fixing portion of the movable member 6. Consequently, there is exposed the portion on the surface of the TiW film 26 that corresponds to the supporting and fixing portion of the movable member 6. The gap formation member 21*a* is formed by the Al film as each of the gap formation members 21 shown in FIGS. 5A to 5C and FIGS.

7A to 7C to provide a gap between the movable member 6 and the elemental substrate 1. However, the gap formation member 21*a* is different from the gap formation member 21 in that this member is formed on the entire surface of the TiW film 26 that includes the position corresponding to the bubble generating area 10 between the heat generating element 2 and the movable member 6 shown in FIG. 3 but excepting only the portion that corresponds to the supporting and fixing portion of the movable member 6. Therefore, in accordance with the method of the present embodiment, the gap formation member 21*a* is formed up to the portion of the surface of the TiW film 26 that corresponds to the flow path side walls unlike the method of manufacture described in conjunction with FIGS. 5A to 5C and FIGS. 7A to 7C.

The gap formation member 21*a* functions as the etching stop layer when the movable member 6 is formed by use of the dry etching to be described later. This is needed because the TiW layer 26, the Ta film serving as the cavitation proof film provided for the elemental substrate 1, and the SiN film serving as the protection layer on the resistive element are also etched by the etching gas to be used for the formation of the liquid flow paths 7. Therefore, in order to prevent these layers and films from being etched, the gap formation member 21*a* described above is formed on the elemental substrate 1. With the formation thereof, the surface of the TiW film 26 is not exposed when the SiN film is dry etched to form the movable member 6, and the damages that may be caused to the TiW film 26 and the functional elements on the elemental substrate 1 can be prevented with the provision of the gap formation member 21*a*.

Figure 10C:
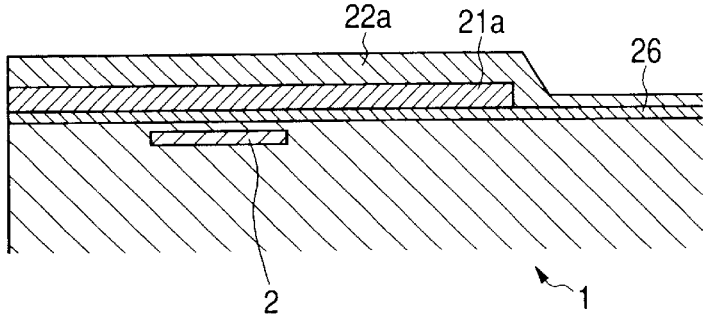

Now, FIG. 10C, on the entire surface of the gap formation member 21*a* and the entire exposed surface of the portion of the TiW film 26, the SiN film 22*a* which is the material film for the formation of the movable member 6 is formed by the plasma CVD method in a thickness of approximately 4.5 $\mu$m so as to cover the gap formation member 21*a*. Here, when the SiN film 22*a* is formed by use of the plasma CVD apparatus, the cavitation proof film provided for the elemental substrate 1 is grounded through the silicon substrate of the elemental substrate 1 as in the method described with reference to FIG. 6. In this manner, it becomes possible to prevent the heat generating elements 2, the latch circuits, and other functional elements on the elemental substrate 1 from being damaged due to the loads generated on the elemental substrate 1 by the decomposed ion seed and radical by the plasmic discharges in the reaction chamber of the plasma CVD apparatus.

Figure 10D:
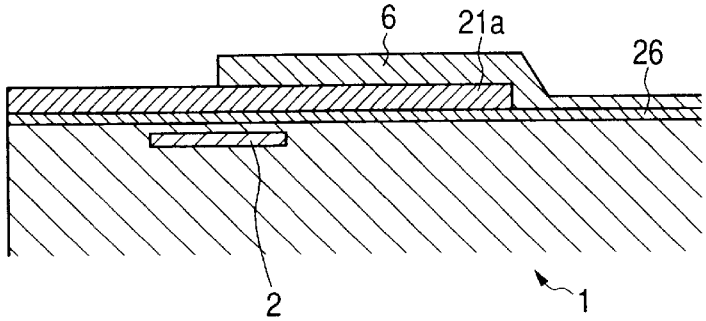

Then, in FIG. 10D, after the Al film is formed by the sputtering method on the surface of the SiN film 22*a* in a thickness of approximately 6100 Å, the Al film thus formed is patterned by use of the known process of photolithography so as to allow the Al film (not shown) to remain intact as the second protect layer on the surface portion of the SiN film 22*a* that corresponds to the movable member 6. The Al film that serves as the second protection layer becomes the protection layer (etching stop layer) when the dry etching is performed on the SiN film 22*a* for the formation of the movable member 6, that is, it becomes the mask needed here.

Then, using the dielectric coupling plasma etching apparatus the SiN film 22*a* is patterned with the aforesaid second protection layer as the mask. Thus, the movable member 6 is formed, which is structured with the remaining portion of the SiN film 22*a*. For the etching apparatus, the mixed gas of $CF_4$ and $O_2$ is used. In the process in which the SiN film 22*a* is patterned, the unwanted portion of the SiN film 22*a* is removed so that as shown in FIG. 3, the supporting and fixing portion of the movable member 6 is directly fixed to the elemental substrate 1. The structural material of the closely contacted portion between the supporting and fixing portion of the movable member 6 and the elemental substrate 1 contains the TiW which is the structural material of the pad protection layer, and the Ta which is the structural material of the cavitation proof film provided for the elemental substrate 1.

Here, when the dry etching apparatus is used for etching the SiN film 22, the gap formation member 21*a* is grounded through the elemental substrate 1 and others as in the same method described with referent to FIG. 8. In this manner, it becomes possible to prevent the ion seed and radical loads generated by the decomposition of the $CF_4$ gas at the time of etching from being stagnated on the gap formation member 21*a*, hence protecting the heat generating elements 2, the latch circuits, and other functional elements on the elemental substrate 1. Also, in the etching process, the gap formation member 21*a* is formed as described above on the portion which is exposed by removing the unwanted portion of the SiN film 22*a*, that is, the area which should be etched. As a result, the surface of the TiW film 26 is not allowed to be exposed, and the elemental substrate 1 is protected exactly by the presence of the gap formation member 21*a*.

Figure 10E:
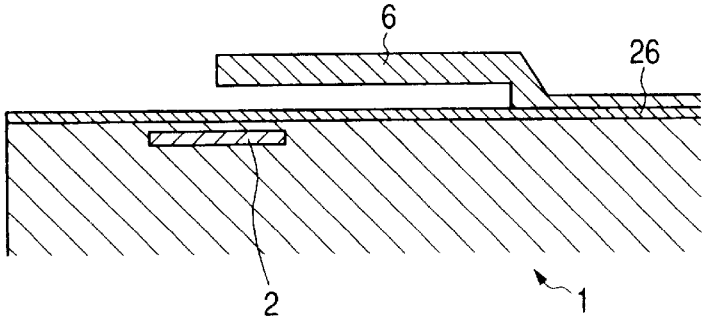

Now, in FIG. 10E, using a mixed acid of acetic acid, phosphoric acid, and nitric acid the aforesaid second protection layer formed by the Al film that constitutes the movable member 6, and the gap formation member 21*a* formed by the Al film are eluted for removal thereof. Then, each of the movable members 6 is embedded in the elemental substrate 1. After that, the portion of the TiW film 26 formed on the elemental substrate 1, which corresponds to the bubble generating areas 10 and pads, is removed by use of hydrogen peroxide.

Subsequently, in the process different from the one in which the movable members 6 are formed on the elemental substrate 1, the grooves are directly formed on the ceiling plate to form the flow path side walls on the ceiling plate or form flow path side walls on one face of the ceiling plate to produce the ceiling plate provided with the flow path side walls 9 equivalent to those shown in FIG. 3. Then, the ceiling plate thus produced is bonded to the elemental substrate 1 having the movable members 6 formed by the method described in conjunction with FIGS. 10A to 10E, hence manufacturing the liquid discharge head whose structure is shown in FIG. 3.

For the method of manufacture described in conjunction with FIGS. 10A to 10E, the description has been made of the case where the supporting and fixing portion of the movable members 6 is directly fixed onto the elemental substrate 1 as shown in FIG. 3. However, it may be possible to manufacture the liquid discharge head having the movable members fixed to the elemental substrate through pedestal portions with the application of this method for manufacturing the liquid discharge head. In this case, prior to the process in which the gap formation member 21*a* is formed as shown in FIG. 10B, the pedestal portions, which fix on the elemental substrate the end portion of the movable member on the side opposite to its free end, are formed for the elemental substrate on the heat generating element side. In this case, too, the structural material of the portion where the pedestals and the elemental substrate are closely connected contains the TiW which is the structural material of the pad protection layer, and the Ta which is the structural material of the cavitation proof film provided for the elemental substrate.

Second Embodiment

Figure 11:
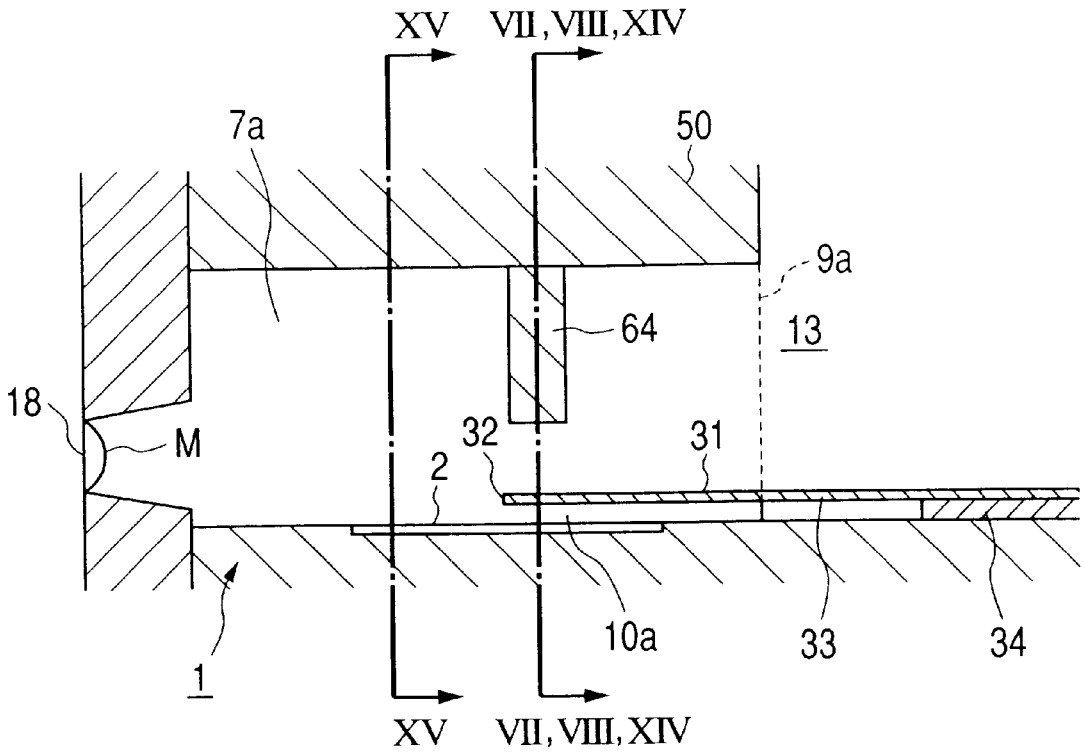
FIG. 11 is a cross-sectional view which shows the liquid discharge head in accordance with a second embodiment of the present invention, taken in the flow path direction.

FIG. 11 is a cross-sectional view which shows the liquid discharge head in accordance with a second embodiment of the present invention, taken in the liquid flow path direction. In FIG. 11, the same reference numerals are applied to the same constituents represented in the first embodiment.

For the liquid discharge head of the present embodiment, the heat generating elements 2 are provided for the flat and smooth elemental substrate 1 for activating thermal energy on liquid as the discharge energy generating elements 2 for discharging liquid as in the first embodiment, and then, the liquid flow paths 7*a* are arranged on the elemental substrate 1 corresponding to the heat generating elements 2. The liquid flow paths 7*a* are communicated with the discharge ports 18, and at the same time, communicated with the common liquid chamber 13 through which liquid is supplied to a plurality of the liquid flow paths 7*a*, thus receiving the amount of liquid from the common liquid chamber 13, which compensates for the amount of liquid having discharged from the discharge ports 18. Here, a reference mark M designates the meniscus that the discharge liquid forms, and the meniscus M is balanced with the inner pressure of the common liquid chamber 13, which is usually negative, by means of the capillary force generated by the discharge port 18 and the inner walls of the corresponding liquid flow path 7*a* which is communicated with this discharge port 18.

Each of the liquid flow paths 7*a* is formed by the ceiling plate 50 is bonded to the elemental substrate 1 having the heat generating elements 2 and the flow path side walls 9*a* formed therefor. In the area neat the surface where each heat generating element 2 and the discharge liquid are in contact, the bubble generating area 10*a* is present in order to create bubbles in the discharge liquid by heating the heat generating element 2 rapidly. Each of the movable members 31 is arranged in the liquid flow path 7*a* having the bubble generating area 10*a* so as to enable at least a part thereof to face the heat generating element 2. The movable member 31 has its free end 32 on the downstream side toward the discharge port 18, and at the same time, it is supported by the supporting member 34 arranged on the upstream side. Particularly, in accordance with the present embodiment, the free end 32 is arranged near the central portion of the bubble generating area 10*a* in order to suppress the development of the half of the bubble on the upstream side which exerts influences on the back waves and the inertia of liquid toward the upstream side. Then, along with the development of the bubble created on the bubble generating area 10*a*, the movable member 31 is displaced with respect to the supporting member 34. At the time of displacement, the fulcrum 33 becomes the supporting portion of the movable member 31 in the supporting member 34.

Above the center of the bubble generating area 10*a*, the stopper (regulating portion) 64 is positioned to regulate the displacement of the movable member 31 within a certain range in order to suppress the development of the half of the bubble on the upstream side.

With the structure thus arranged, the liquid flow path 7*a* having the bubble generating area 10*a* therein becomes an essentially closed space with the exception of the discharge port 18 by the contact between the displaced movable member 31 and the stopper 64, hence proposing the characteristic head structure which has never been made conventionally.

Now, the description will be made of the method for manufacturing the liquid discharge head shown in FIG. 11.

Figure 13A:
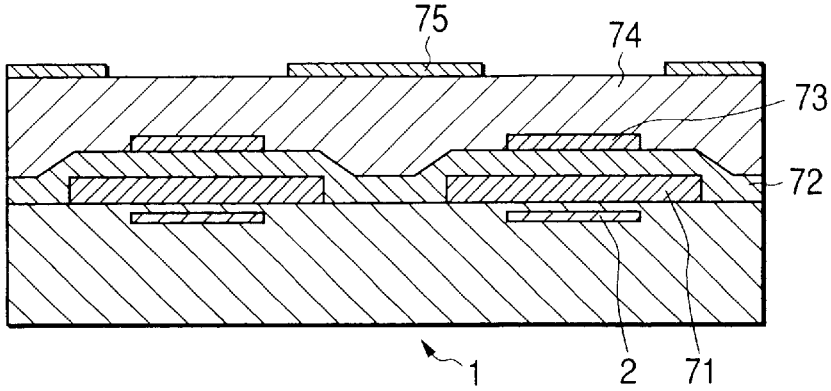
FIGS. 13A, 13B and 13C are views which illustrate the method for forming the movable members, stoppers, and the flow path side walls on the elemental substrate shown in FIG. 11.
Figure 13B:
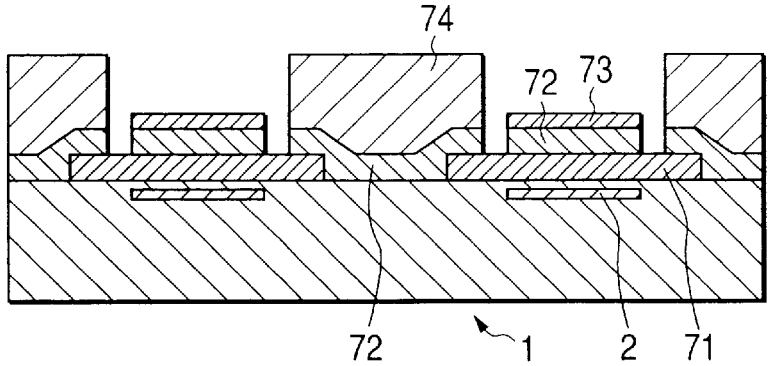
Figure 13C:
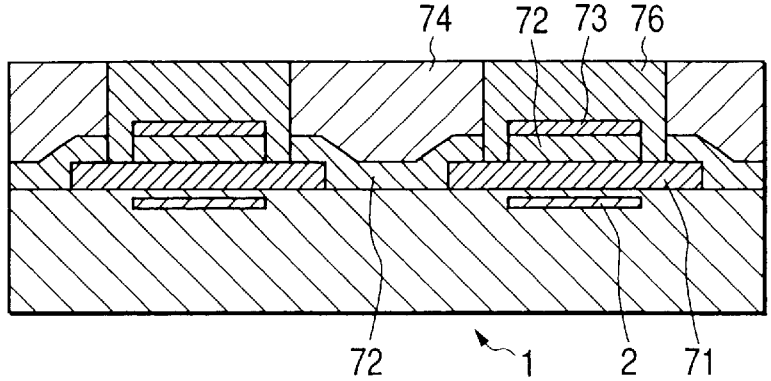
Figure 14A:
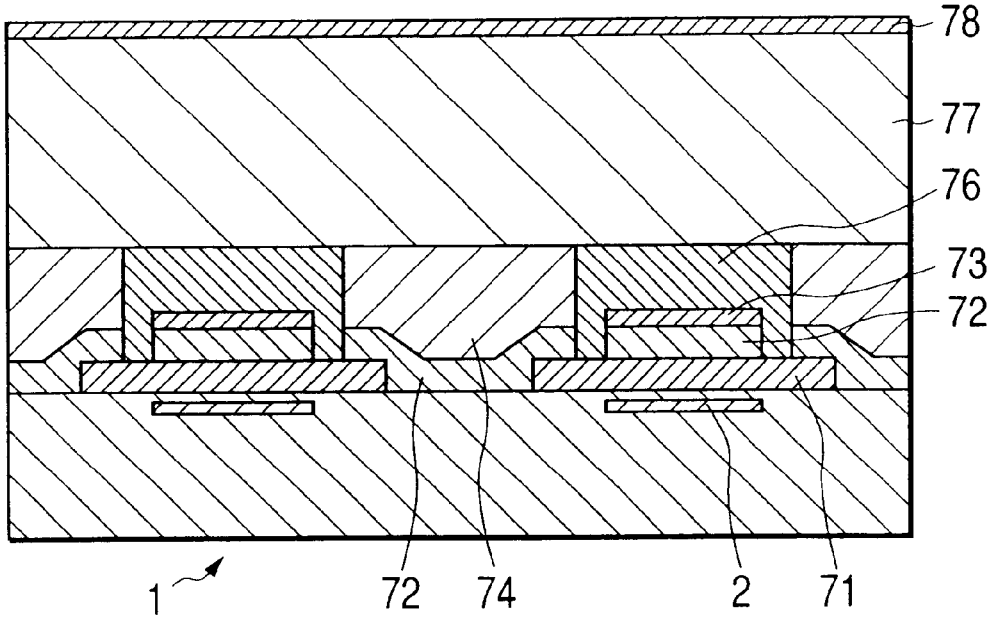
FIGS. 14A and 14B are views which illustrate the method for forming the movable members, stoppers, and the flow path side walls on the elemental substrate shown in FIG. 11.
Figure 14B:
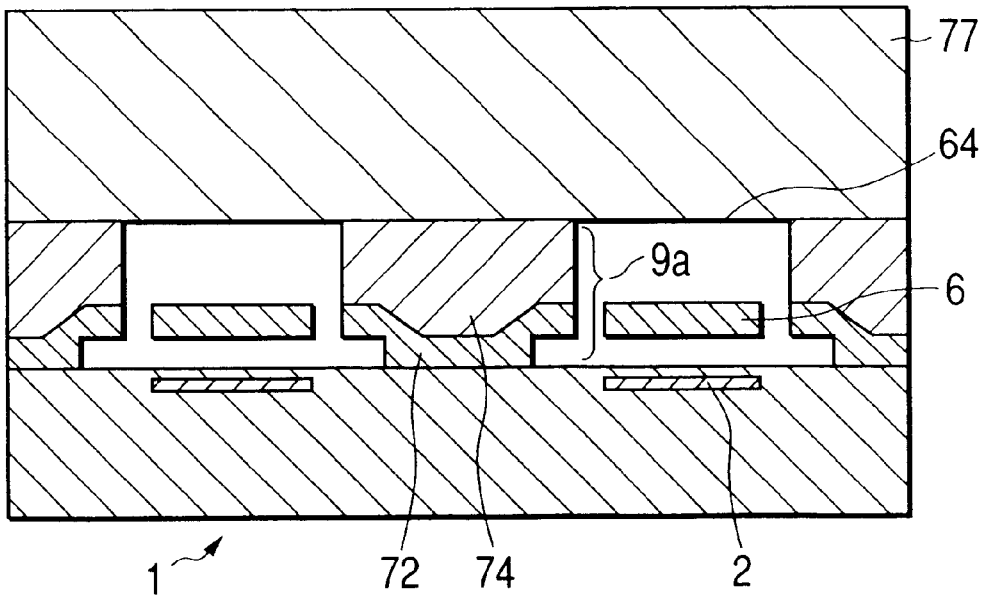
Figure 15A:
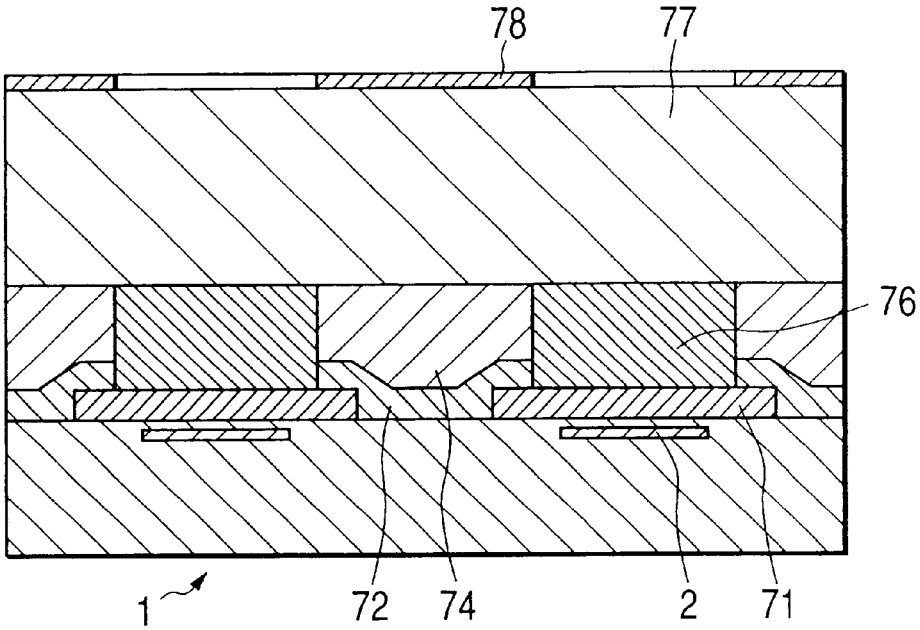
FIGS. 15A and 15B are views which illustrates the processes corresponding to FIGS. 14A and 14B, taken along line XV—XV in FIG. 11.
Figure 15B:
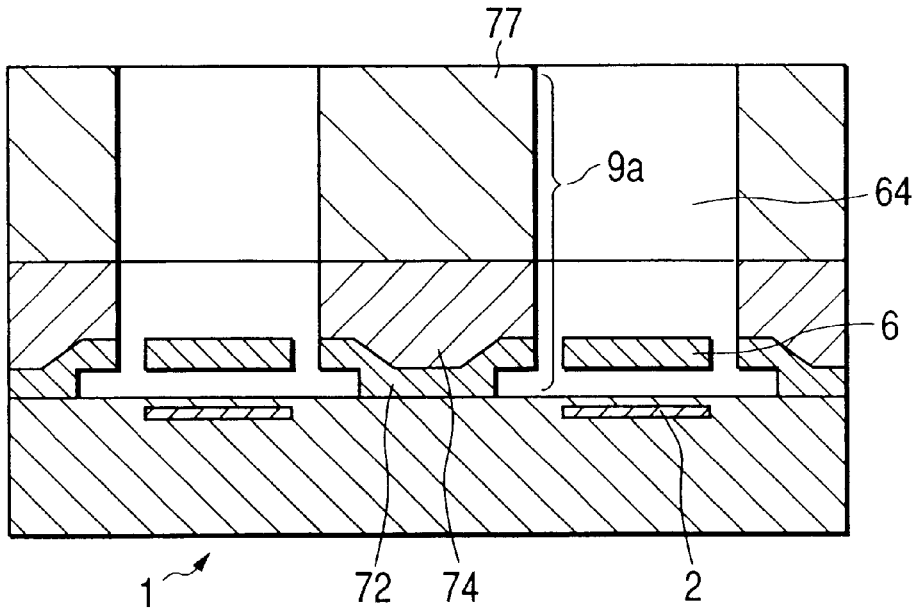

Here, FIGS. 12A to 12C, FIGS. 13A to 13C, FIGS. 14A and 14B, and FIGS. 15A and 15B are views which illustrate the method for forming the movable members 31, stoppers 64, and the flow path side walls 9*a* on the elemental substrate 1 shown in FIG. 11. Through the processes shown in FIG. 12A to FIG. 14B, the movable members 31, stoppers 64, and the flow path side walls 9 are formed on the elemental substrate 1. In this respect, FIGS. 12A to 12C, FIGS. 13A to 13C, FIGS. 14A and 14B are views which illustrate each of the processes, taken along the linear sections of XII—XII, XIII—XIII, and XIV—XIV in FIG. 11, respectively. FIGS. 15A and 15B are views which illustrate the processes that correspond to those in FIGS. 14A and 14B, taken along-the linear section of XV—XV.

Figure 12A:
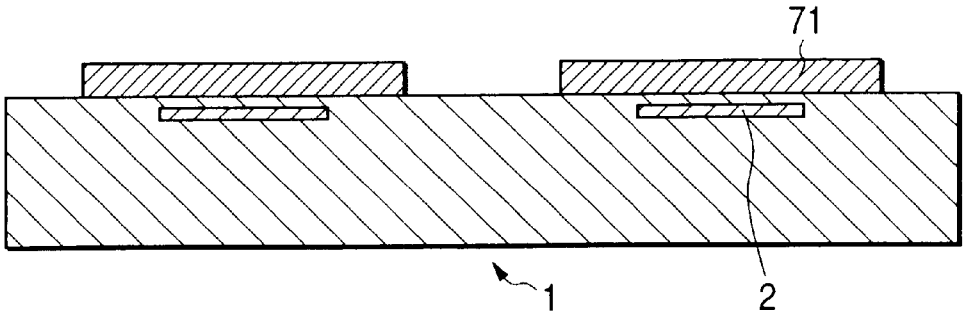
FIGS. 12A, 12B and 12C are views which illustrate the method for forming the movable members, stoppers, and the flow path side walls on the elemental substrate shown in FIG. 11.

At first, in FIG. 12A, TiW film (not shown) is formed by the sputtering method on the entire surface of the elemental substrate 1 on the heat generating element 2 side in a thickness of approximately 5000 Å as the first protection layer to protect the connecting pad portions to be electrically connected with the heat generating elements 2. On the surface of the elemental substrate 1 on the heat generating element 2 side, the Al film is formed by the sputtering method in a thickness of approximately 5 $\mu$m for the provision of the gap formation members 71. The Al film thus formed is patterned by use of the known photolithographic process. Then, on each position that corresponds to the bubble generating area 10*a* between the heat generating element 2 and the movable member 31 shown in FIG. 11, each of the Al film gap formation members 71 is formed in order to provide the gap between the elemental substrate 1 and each of the movable members 31. Each of the gap formation members 71 is extended up to the area where the etching is made on the SiN film 72 which is the film material for the formation of the movable members 31 in the process shown in FIG. 13B to be described later.

The gap formation member 71 functions as the etching stop layer when the liquid flow paths 7*a* are formed by the dry etching which will be described later. The TiW layer that serves as the pad protection layer on the elemental substrate 1, the Ta film that serves as the cavitation proof film, and the SiN film that serves as the protection layer on the resistive elements are subjected to be etched by use of etching gas at the time of forming the liquid flow paths 7*a*. Therefore, with the provision of the gap formation members 71, these layers and films are prevented from being etched. For this purpose, each width of the gap formation members 71 is made wider in the direction orthogonal to the flow path direction of the liquid flow paths 7*a* than the width of each liquid flow paths 7*a* so that the surface of the elemental substrate 1 on the heat generating element 2 side and the TiW layer on the elemental substrate 1 are not allowed to be exposed when the liquid flow paths 7*a* are formed by use of the dry etching.

Further, when the dry etching is performed, the $CF_4$ gas is decomposed to generate the ion seed and radical which may damage the heat generating elements 2 and functional elements on the elemental substrate 1. However, the gap formation member 71 formed by Al catches the ion seed and radical to protect the heat generating elements 2 and the functional elements on the elemental substrate 1.

Figure 12B:
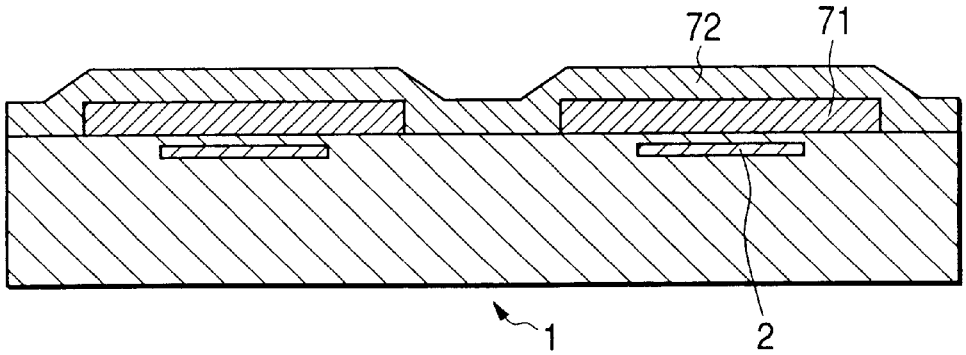

Now, in FIG. 12B, the SiN film 72, which is the material used for the formation of the movable members 31, is formed by the plasma CVD method in a thickness of approximately 5 $\mu$m on the surface of the gap formation members 71 and the surface of the elemental substrate 1 on the gap formation member 71 side. Here, when the SiN film 72 is formed by use of the plasma CVD apparatus, the cavitation proof provided for the elemental substrate 1 is grounded in order to prevent the heat generating elements 2, the fetch circuits, and other functional elements on the elemental substrate 1 from being damaged as in the first embodiment.

Figure 12C:
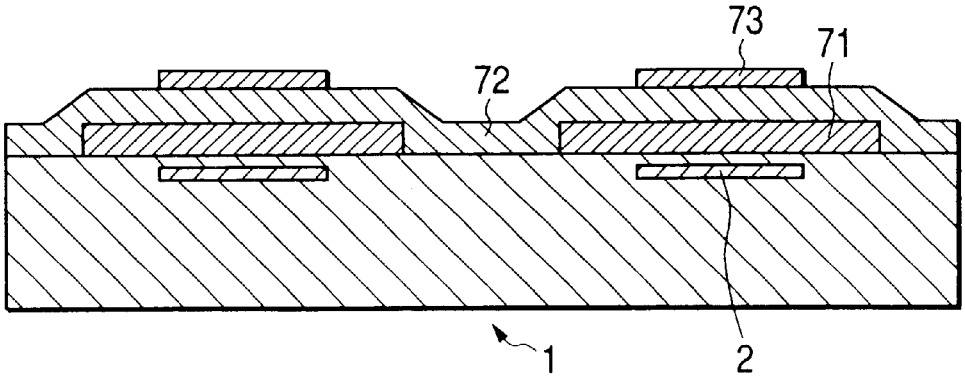

Now, in FIG. 12C, the Al film is formed by the sputtering method on the surface of the SiN film 72 in a thickness of approximately 1.0 μm. After that, the Al film thus formed is patterned by the known process of photolithography so as to allow the Al film 73 to be left intact as the second protection layer on the surface portion of the SiN film 72 which corresponds to the movable members 31. The Al film 73 becomes the protection layer (etching stop layer) when the liquid flow paths 7*a* are formed by use of the dry etching.

Now, in FIG. 13A, the SiN film 74 used for the formation of the flow path walls 9*a* is formed by the microwave CVD method on the surface of the SiN film 72 and the Al film 73 in a thickness of approximately 20 μm. Here, as the gas which is used for the SiN film 74 formation by the microwave CVD method, monosilane ($SiH_4$), nitrogen ($N_2$), and argon (Ar) are used. As the combination thereof, it may be possible to use disilane ($Si_2H_6$), ammonium ($NH_3$), or the like besides those mentioned above or use them as a mixed gas. Also, with the microwave power of 1.5 [kW] at the frequency of 2.45 [GHz], the SiN film 74 is formed under high vacuum pressure of 5 [mTorr] with each of gasses at the gas flow rate of 100 [sccm] monosilane, 100 [sccm] nitrogen, and 40 [sccm] argon, respectively. Here, it may be possible to form the SiN film 74 by the microwave CVD method or the CVD method using the RF power supply in the gas composition ratio other than the one mentioned above. When the SiN film 74 is formed by the CVD method, too, the cavitation proof film provided for the elemental substrate 1 should be grounded.

Then, after the Al film is formed on the entire surface of the SiN film 74, the Al film thus formed is patterned by the known method of photolithography or the like to form the Al film 75 on the portion of the surface of the SiN film 74 with the exception of the portion corresponding to the liquid flow paths 7*a*.

Subsequently, in FIG. 13B, the SiN film 74 and the SiN film 72 are patterned by use of the etching apparatus that adopts dielectric coupling plasm. Here, using a mixed gas of $CF_4$ and $O_2$ the SiN film 74 and the SiN film 72 are etched with the Al films 73 and 75, and the gap. formation members 71 being used as the etching stop layer so that the SiN film 74 presents its trench structure. At this juncture, the gap formation members 71 are grounded through the cavitation proof film and the silicon substrate of the elemental substrate 1 as in the first embodiment in order to prevent the heat generating elements 2, the latch circuits, and other functional elements on the elemental substrate 1 from being damaged by the ion seed and radical loads.

Then, in FIG. 13C, in order to form the space for each of the movable members 31 to be able to displace, the Al film 76 is buried into the such space, that is, the portion where the SiN film 74 has been removed. As the method for burying the Al film 76, it may be possible to adopt the Al reflowing method in which the Al film is formed by the sputtering method in a thickness of 20 μm on the surface of the SiN film 74 and the Al film 73 and the portion where the gap formation members 71 are exposed, and after that, the Al film thus formed is heated in vacuum at a temperature of 400 to 500° C. or to adopt the Al selection CVD method in which the Al film is laminated selectively only n the recessed portion where the SiN film 74 has been removed, or it may be possible to use the smoothing method applicable to the surface of thick resist film by use of polishing, such as CMP (Chemical Mechanical Polishing), after having coated the thick film resist on the surface of the SiN film 74 and Al film 73 or the like.

Then, in FIGS. 14A and 15A, with the cavitation proof film provided for the elemental substrate 1 being grounded, the SiN film 77 is formed by the micro wave CVD method in a thickness of approximately 30 μm in order to form the stoppers 64 and the flow path side walls 9*a*. Then, after the Al film is formed by the sputtering method on the surface of SiN film 77 in a thickness of 3.0 μm, the Al film thus formed is patterned by use of the known photolithographic process so as to allow the Al film 78 to remain intact on the surface portion of the SiN film 77 that corresponds to the flow path side walls 9*a* and the stoppers 64.

Then, in FIGS. 14B and 15B, using the dielectric coupling plasma etching apparatus the SiN film 77 is etched with the Al films 76 and 78 being used as the etching stop layers so that the SiN film 77 presents the trench structure. Here, also, as in the process shown in FIG. 13B, the gap formation members 71 are grounded so that the heat generating elements, the latch circuits, and other functional elements on the elemental substrate 1 are prevented from being damaged by the ion seed and radical loads. After that, using a mixed acid of acetic acid, phosphoric acid, and nitric acid the Al films are hot etched to remove the Al films 78, 76, and 73, and the gap formation members 31 formed by the Al film. Then, the movable members 71 and the flow path side walls 9*a* are embedded in the elemental substrate 1. Subsequently, the portion of the TiW film serving as the pad protection layer formed on the elemental substrate 1, which corresponds to the bubble generating areas 10 and pads, is removed by use of hydrogen peroxide.

Subsequent to having formed the movable members 31, the stoppers 64, and the flow path side walls 9*a* on the elemental substrate 1 as described above, the ceiling plate 3 is bonded to the surface of the elemental substrate 1 on the flow path side wall 9*a* side, and at the same time, the orifice plate 4 having the discharge ports 5 formed therefor is bonded to the front end of the elemental substrate 1 and the ceiling plate 3 in the same manner as the first embodiment described in conjunction with FIG. 9, hence manufacturing the liquid discharge head shown in FIG. 11.

In accordance with the method of the present embodiment for manufacturing a liquid discharge head, it becomes possible to manufacture the highly reliable liquid discharge head in high precision, because the stoppers 64 can be formed in high precision and high density.

Third Embodiment

As described above, in the movable member formation process for the liquid discharge head in accordance with the present invention, the gap formation members are formed between the heat generating element area for creating bubbles and the movable members, and the gap formation members are completely removed in the last. At the juncture, there is a need for a long time immersion in a strong acid solution for the complete removal of the gap formation members. The etching of the Al sacrifice layer, which serves as the gap formation member, is slower on the portions of the movable members where the gap formation members are formed, and faster on the portions which are formed on the pads. Consequently, the pad portions are exposed to the etching solution for a long time until the Al sacrifice layer is completely removed. Then, an immersion process of the kind tends to become a cause of the erosion that may affect the pads used for external electric connection, which may lead to marring the reliability of the liquid discharge head eventually. Therefore, with the arrangement to keep the protection layer to remain intact on the pads when the gap formation members are removed, it becomes possible to significantly reduce the possibility that the pads may be affected by the etching solution. Further, usually, the protection layer is formed with the $SiO_2$ or SiN material. However, since a material of the kind presents pin holes, it becomes more reliable to protect the pads from the etching solution with the provision of the TiW further on the protection layer, because with this, the pin holes are covered.

In this manner, it becomes possible to reduce the erosion of the electric pads or the like in the wet process to be conducted for the large-scale production of the movable members of the present invention, hence enhancing the production yield thereof on the wafer.

Now, hereunder, in conjunction with FIGS. 16A to 16E, the method will be further described in detail.

FIGS. 16A to 16E are cross-sectional views which illustrate the manufacturing process of the movable member on the substrate of the liquid discharge head in accordance with the present embodiment, taken in the flow path direction.

Figure 16A:
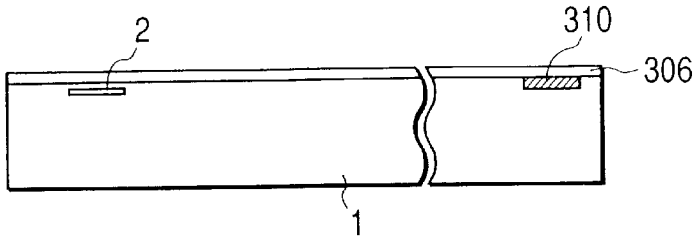
FIGS. 16A, 16B, 16C, 16D and 16E are cross-sectional views which illustrate the movable members manufactured on the substrate of the liquid discharge head in accordance with a third embodiment of the present invention, taken in the flow path direction.

FIG. 16A shows the state of the SiN film which serves as the protection layer 306 on the second Al layer of the electrode pads 310 being left intact. In this respect, the cavitation proof film formed on the uppermost layer on the electrode pads 310 shown in FIG. 2 is also patterned and removed by the known photolithographic process.

Figure 16B:
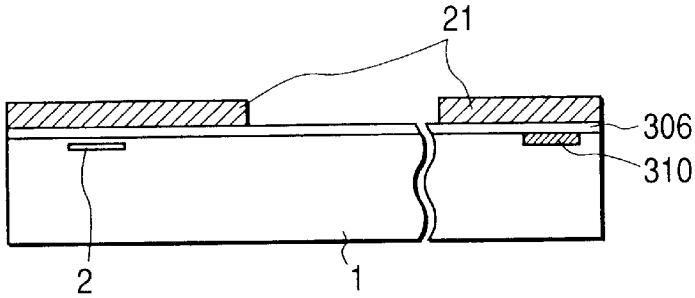

In FIG. 16B, the Al film which becomes the gap formation member 21 between the heat generating element 2 and the movable member 6 on the elemental substrate 1 is formed by the sputtering method in a film thickness of approximately 5.0 $\mu$m, and then, patterned by the known photolithographic process.

Figure 16C:
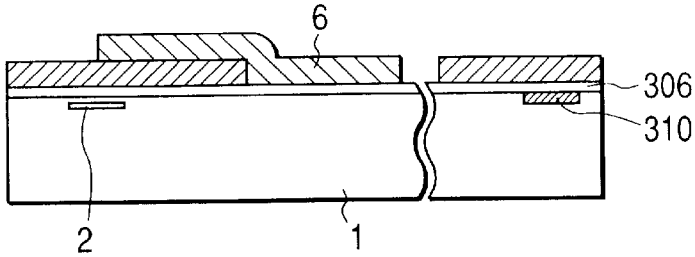

After that, in FIG. 16C, using the plasma CVD method the SiN film is formed in a thickness of approximately 5 $\mu$m, and then, patterned by the photolithographic process for the formation of the comb-shaped movable members and-the pedestal portion. After that, the Al film 21 is etched to form the etching stop layer.

Figure 16D:
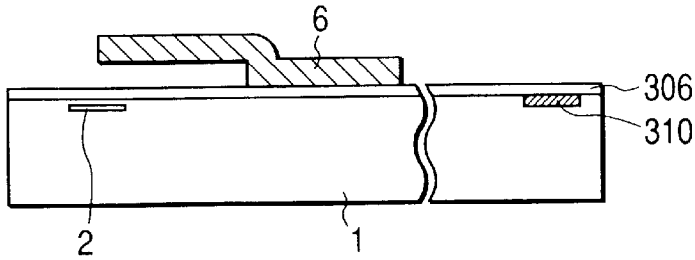

Subsequently, as shown in FIG. 16D, the Al film 21 is hot etched using a mixed acid of acetic acid, nitric acid, and hydrochloric acid to remove the Al film 21.

Figure 16E:
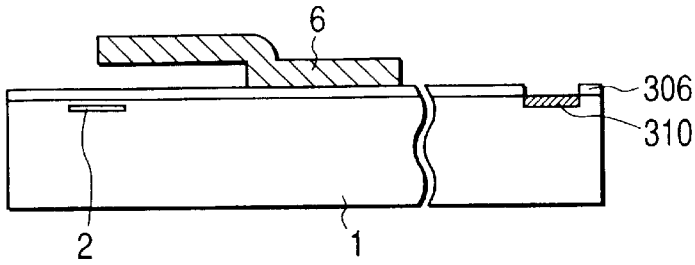

Then, in FIG. 16E, the SiN protection film 306 is removed by the dry etching so as to allow the pads 310 to be exposed.

Liquid Discharge Recording Apparatus

Figure 17:
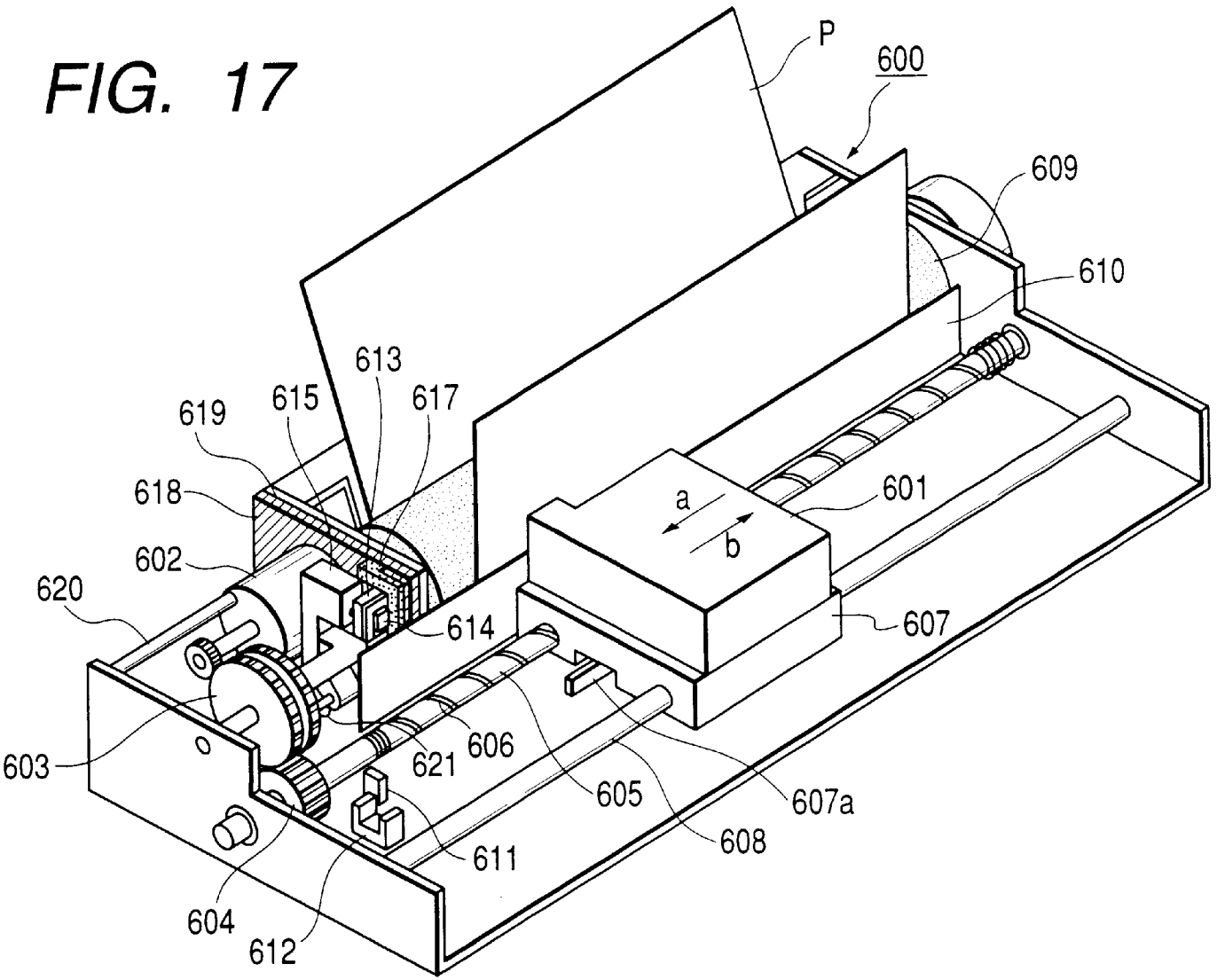
FIG. 17 is a perspective view which shows an ink jet recording apparatus which is one example of the liquid discharge recording apparatus having on it the liquid discharge head shown in FIG. 3 or the liquid discharge head shown in FIG. 11.
Figure 18A:
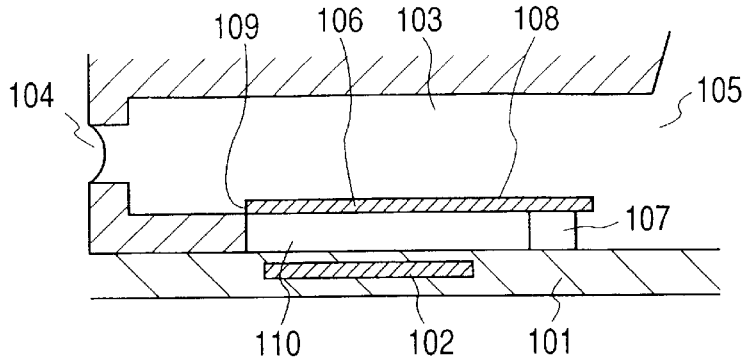
FIGS. 18A, 18B, 18C and 18D are views which illustrate the discharge principle of the conventional liquid discharge head.
Figure 18B:
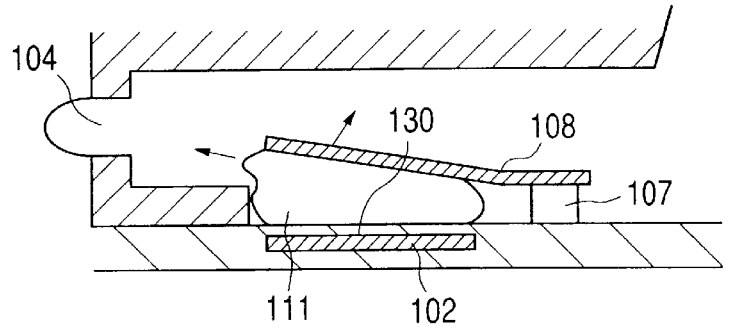
Figure 18C:
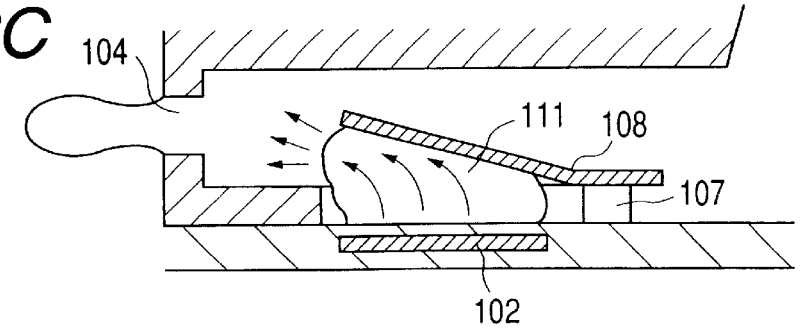
Figure 18D:
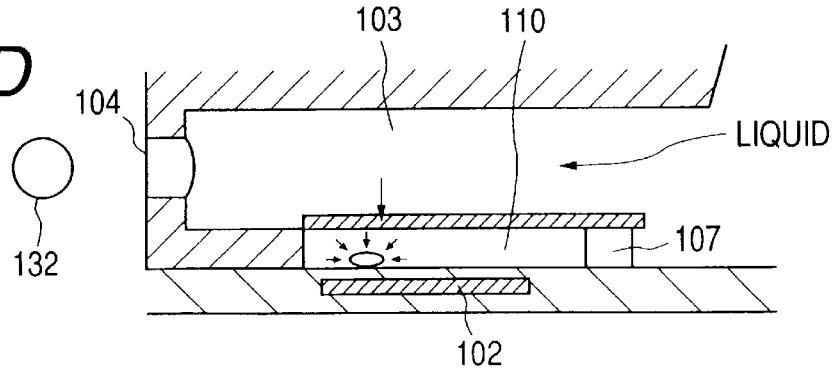
Figure 19:
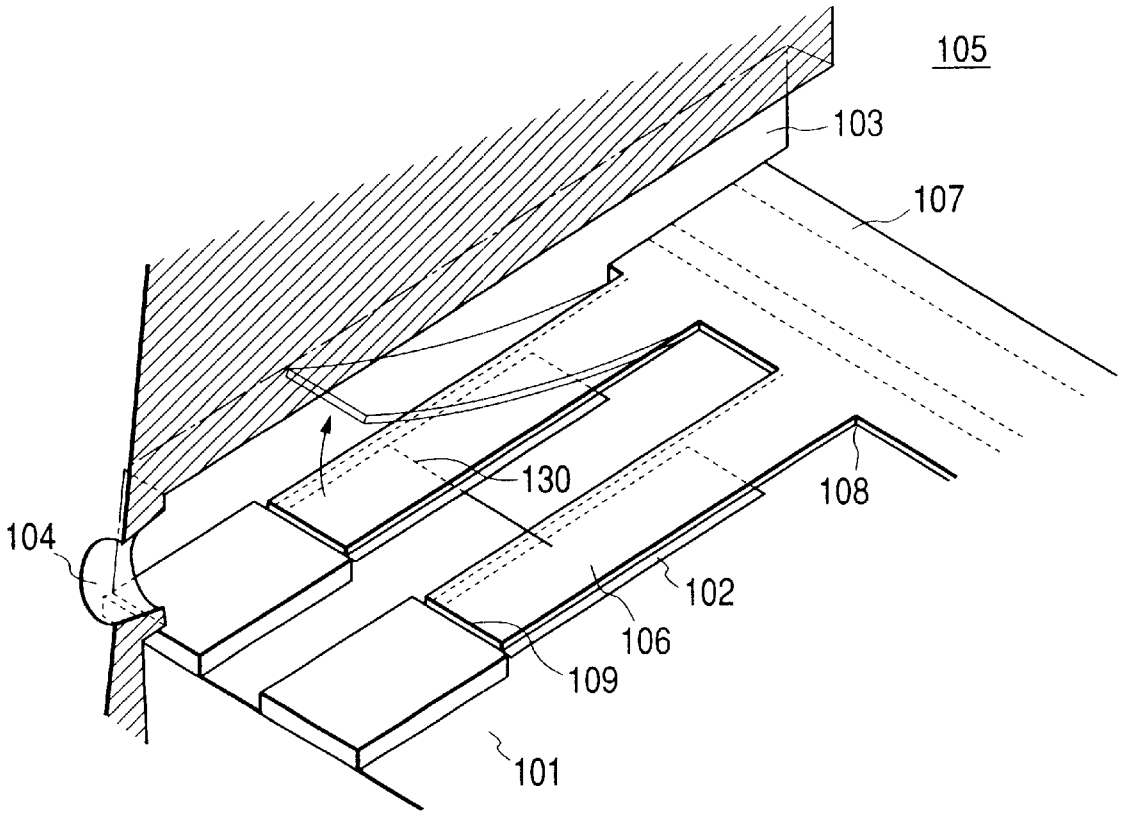
FIG. 19 is a partly broken perspective view which shows the liquid discharge head represented in FIGS. 18A to 18D.
Figure 20:
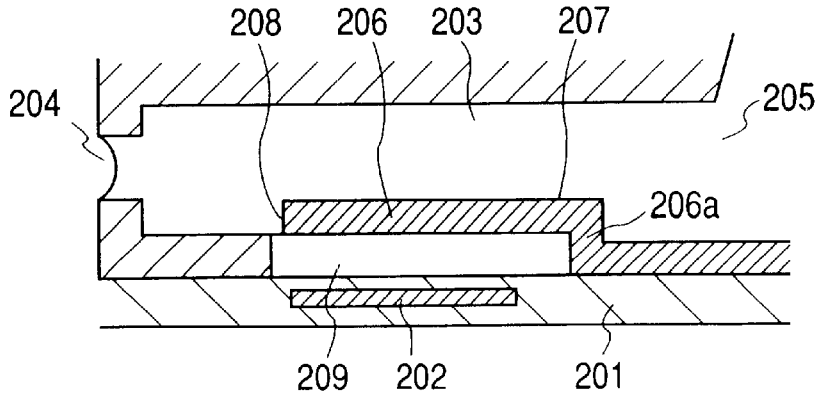
FIG. 20 is a cross-sectional view which shows the variational example of the liquid discharge head represented in FIGS. 18A to 18D.

FIG. 17 is a perspective view showing an ink jet recording apparatus which one example of the liquid discharge recording apparatus provided with the liquid discharge head shown in FIG. 3 or the liquid discharge head shown in FIG. 11. The head cartridge 601 mounted on the ink jet recording apparatus 600 shown in FIG. 17 is provided with a liquid discharge head of the first or the second embodiment, and also, with the liquid container that holds liquid to be supplied to the liquid discharge head. As shown in FIG. 17, the head cartridge 601 is mounted on the carriage 607 which engages with the spiral groove 606 of the rotating lead screw 605 interlocked with the regular and reverse rotations of the driving motor 602 through the drive power transmission gears 603 and 604. With the carriage 607, the head cartridge 601 travels by the driving power of the driving motor 602 to reciprocate along the guide 608 in the directions indicated by arrows a and b. For the ink jet recording apparatus 600, recording medium carrying means (not shown) is provided to carry the printing sheet P as the recording medium that receives liquid, such as ink, discharged from the head cartridge 601. The paper pressure plate 610 for use of the printing sheet P carried on the platen 609 by means for carrying the recording medium is arranged to press the printing sheet P onto the platen 609 in the traveling direction of the carriage 607.

In the vicinity of one end of the lead screw 605, the photocouplers 611 and 612 are arranged. The photocouplers 611 and 612 serves as home position detecting means that confirms the presence of the lever 607*a* of the carriage 607 in the functioning region of the photocouplers 611 and 612 in order to switch over the rotating directions of the driving motor 602. In the vicinity of one end of the platen 609, there is arranged the supporting member 613 to support the cap member 614 to cover the front face of the discharge ports of the head cartridge 601. Also, ink suction means 615 is provided for sucking the ink retained in the interior of the cap member 614 due to the idle discharges or the like from the head cartridge 601. This ink suction means 615 performs the suction recovery of the head cartridge 601 through the aperture of the cap member 614.

For the ink jet recording apparatus 600, the main body supporting member 619 is provided. For this main body supporting member 619, the shiftable member 618 is movably supported in the forward and backward directions, that is, in the direction at right angles to the traveling direction of the carriage 607. The cleaning blade 617 is mounted on the shiftable member 618. The cleaning blade 617 is not necessarily in this mode. Any other cleaning blade in the known mode may be adoptable. Further, the lever 620 is arranged in order to initiate suction for the suction recovery operation of the ink suction means 615. The lever 620 moves along with the movement of the cam 621 which engages with the carriage 607, and the movement thereof is controlled by the known transmission means, such as clutch switching, which controls the transmission of the driving power of the driving motor 602. The ink jet recording controller is installed on the main body of the ink jet recording apparatus to supply signals to the heat generating elements provided for the head cartridge 601 or performs the driving controls of each mechanism described above. This controller is not shown in FIG. 17. For the ink jet recording controller, driving signal supply means is provided, which supplies driving signals to the liquid discharge head for discharging liquid.

The ink jet recording apparatus 600 thus structured performs recording on the printing sheet P carried onto the platen 609 by the aforesaid recording medium carrying means, while the head cartridge 601 travels to reciprocate over the entire width of the printing sheet P.

Also, the ink jet recording apparatus 600 is provided with the liquid discharge head whose discharge characteristics are stabilized as described above, making it possible to perform recording on the recording medium stably against the temperature changes or the like.

What is claimed is:

1. A method for manufacturing a liquid discharge head having a discharge port for discharging liquid;

a liquid flow path communicating with the discharge port for supplying the liquid to the discharge port;

a heat generating element arranged in the liquid flow path for creating a bubble in the liquid;

an elemental substrate having the heat generating element therefor; and a movable member arranged for the elemental substrate having a free end thereof on the discharge port side with a gap with the elemental substrate in a position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, said method comprising the following steps of:

forming a gap formation member with Al to form the gap between the elemental substrate and the movable member on the surface of the elemental substrate on the heat generating element side, wherein the gap formation member functions as an etching stop layer upon forming the movable member with dry etching;

forming a material film for the formation of a movable member to cover the gap formation member;

patterning the material film by dry etching; and forming the gap by eluting the gap formation member, wherein the gap formation member is formed with Al being extended to the etching area of the material film.

2. A method for manufacturing a liquid discharge head according to claim 1, wherein silicon is used as a material of the elemental substrate, and where the material film of the movable member is selected from the group consisting of silicon nitride, silicon oxide, and silicon carbide.

3. A method for manufacturing a liquid discharge head according to claim 1, wherein the elemental substrate is provided with a liquid flow path side wall for forming the liquid flow path, and the liquid flow path side wall is formed simultaneously with the movable member by laminating on the material film the film for the formation of the liquid flow path side wall after the etching proof film is provided for the movable member formation area of the material film, and then, dry etching is conducted.

4. A method for manufacturing a liquid discharge head according to claim 1, wherein, in the step of said dry etching, the gap formation member is grounded through the substrate electrically connected with the gap formation member.

5. A method for manufacturing a liquid discharge head according to claim 1, wherein, in the step of eluting the gap formation member, hot etching is used with a mixed acid of acetic acid, phosphoric acid, and nitric acid.

6. A method for manufacturing a liquid discharge head according to claim 1, wherein the structural material of the close contact portion between the supporting and fixing portion of the movable member and the elemental substrate contains TiW or Ta.

7. A method for manufacturing a liquid discharge head according to claim 1, further comprising the following step of:

forming a pedestal portion for fixing the end portion on the side opposite to the free end of the movable member on the surface of the elemental substrate on the heat generating element side before the step of forming the gap formation member.

8. A method for manufacturing a liquid discharge head according to claim 7, wherein the structural material of the close contact portion between the pedestal portion and the elemental substrate contains TiW or Ta.

9. A method for manufacturing a liquid discharge head according to claim 1, wherein the structural material of the close contact portion between the flow path side wall and the elemental substrate contains TiW or Ta.

10. A liquid discharge head for discharging liquid by utilization of a bubble created by applying thermal energy to the liquid, the liquid discharge head being manufactured by a method for manufacturing a liquid discharge head according to claim 1.

11. A head cartridge comprising:

a liquid discharge head according to claim 10, and a liquid container for holding liquid to be supplied to said liquid discharge head.

12. A liquid discharge recording apparatus comprising:

a liquid discharge head according to claim 10; and means for supplying driving signal to supply driving signal for discharging liquid from said liquid discharge head.

13. A liquid discharge recording apparatus comprising:

a liquid discharge head according to claim 10; and means for carrying a recording medium to carry the recording medium for receiving liquid discharged from said liquid discharge head.

14. A method for manufacturing a liquid discharge head having a discharge port for discharging liquid;

a liquid flow path communicating with the discharge port for supplying the liquid to the discharge port;

a heat generating element arranged in the liquid flow path for creating a bubble in the liquid;

an elemental substrate having the heat generating element therefor; and a movable member arranged for the elemental substrate having a free end thereof on the discharge port side with a gap with the elemental substrate in a position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, said method comprising the following steps of:

forming a gap formation member with Al to form the gap between the elemental substrate and the movable member on the surface of the elemental substrate on the heat generating element side, forming a material film for the formation of a movable member to cover the gap formation member;

patterning the material film by dry etching; and forming the gap by eluting the gap formation member, wherein the gap formation member is formed with Al being extended to the etching area of the material film, wherein the elemental substrate is provided with a liquid flow path side wall for forming the liquid flow path, and the liquid flow path side wall is formed simultaneously with the movable member by laminating on the material film the film for the formation of the liquid flow path side wall after the etching proof film is provided for the movable member formation area of the material film, and then, dry etching is conducted, wherein the elemental substrate is provided with the cavitation proof film formed by Ta, and the cavitation proof film is grounded when the film for the formation of the flow path side wall is formed by plasma CVD method.

15. A method for manufacturing a liquid discharge head having a discharge port for discharging liquid;

a liquid flow path communicating with the discharge port for supplying the liquid to the discharge port;

a heat generating element arranged in the liquid flow path for creating a bubble in the liquid;

an elemental substrate having the heat generating element therefor; and a movable member arranged for the elemental substrate having a free end thereof on the discharge port side with a gap with the elemental substrate in a position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, said method comprising the following steps of:

forming a gap formation member with Al to form the gap between the elemental substrate and the movable member on the surface of the elemental substrate on the heat generating element side, forming a material film for the formation of a movable member to cover the gap formation member;

patterning the material film by dry etching; and forming the gap by eluting the gap formation member, wherein the gap formation member is formed with Al being extended to the etching area of the material film, wherein a pad is arranged on the surface of the elemental substrate having the heat generating element formed therefor to connect the heat generating element outside the head, and the gap formation member is arranged on the pad through a protection layer, and the protection layer is removed after the gap formation member is eluted.

16. A method for manufacturing a liquid discharge head according to claim 15, wherein silicon nitride is used as a material of the protection layer.

17. A method for manufacturing a liquid discharge head according to claim 16, wherein TiW is used as the protection layer on the silicon nitride.

18. A method for manufacturing a liquid discharge head according to claim 17, wherein removal of the TiW is performed by etching using hydrogen peroxide.

19. A method for manufacturing a liquid discharge head having:

a discharge port for discharging liquid;

a liquid flow path communicating with the discharge port for supplying the liquid to the discharge port;

an elemental substrate having a heat generating element provided for one face side thereof for creating a bubble in the liquid in the liquid flow path;

a liquid flow path side wall formed on the elemental substrate to form the liquid flow path; and a movable member arranged for the elemental substrate, having a free end thereof on the discharge port side with a gap with the elemental substrate in a position facing the heat generating element on the elemental substrate, the free end of the movable member being displaced on the discharge port side centering on the fulcrum structured near the supporting and fixing portion with the elemental substrate by the pressure exerted by the creation of the bubble for discharging the liquid from the discharge port, said method comprising the following steps of:

forming a gap formation member locally for the formation of the gap between the elemental substrate and the movable member on the surface of the elemental substrate on the heat generating element side;

forming the silicon material film for the formation of the movable member on the surface of the elemental substrate on the heat generating element side;

forming a first mask layer on the surface portion of the material film for the formation of the movable member corresponding to the movable member;

forming the silicon material film for the formation of the flow path side wall on the surface of the material film for the formation of the movable member and the surface of the first mask layer;

forming a second mask layer on the surface portion of the film for the formation of the flow path side wall;

forming at least a part of the liquid flow path and the flow path side wall by patterning the material film for the formation of movable member and the film for the formation of the flow path side wall by etching using the first and second masks, and removing the gap formation member and the second protection layer to form the movable member.

20. A method for manufacturing a liquid discharge head according to claim 19, wherein plasma CVD method is used in said step of forming the material film for the formation of the movable member, and in said step of forming the film for the formation of the flow path side wall.

21. A method for manufacturing a liquid discharge head according to claim 19, wherein Al or an alloy containing Al is used for the material of the second mask layer, and a sputtering method and photolithographic process are used, in said step of forming the gap formation member and in said step of forming the second protection layer.

22. A method for manufacturing a liquid discharge head according to claim 21, wherein the alloy containing Al is selected from the group consisting of Al—Cu, Al—Ni, Al—Cr, Al—Co, and Al—Fe.

23. A method for manufacturing a liquid discharge head having:

a discharge port for discharging liquid;

a liquid flow path communicating with the discharge port for supplying the liquid to the discharge port;

an elemental substrate having a heat generating element provided for one face side thereof for creating a bubble in the liquid in the liquid flow path;

a liquid flow path side wall formed on the elemental substrate to form the liquid flow path; and a movable member arranged for the elemental substrate, having a free end thereof on the discharge port side with a gap with the elemental substrate in a position facing the heat generating element on the elemental substrate, and a stopper portion to regulate the displacement of the movable member, the free end of the movable member being displaced on the discharge port side centering on the fulcrum structured near the supporting and fixing portion with the elemental substrate by the pressure exerted by the creation of the bubble for discharging the liquid from the discharge port, said method comprising the following steps of:

arranging a film for the formation of the flow path side wall on the movable member on the elemental substrate, wherein the film functions as an etching stop layer upon forming the liquid flow path side wall with dry etching; and embedding part of liquid flow path and the stopper portion simultaneously on the movable member by etching the film using the pattern different from the liquid flow path pattern in the movable area of the movable member.

24. A method for manufacturing a liquid discharge head according to claim 23, wherein said step of forming the stopper portion comprises the following steps of:

embedding the film for the formation of space in the liquid flow path to make the movable member displaceable;

forming the film for the formation of the stopper portion on the surface of the film for the formation of the flow path side wall and the surface of the film for the formation the space to make the movable member displaceable; and forming the stopper portion by patterning the film for the formation of the stopper portion using photolithographic process.

* * * * *

UNITED STATES PATENT AND TRADEMARK OFFICE

CERTIFICATE OF CORRECTION

PATENT NO. : 6,491,834 B1
DATED : December 10, 2002
INVENTOR(S) : Masahiko Kubota et al.

It is certified that error appears in the above-identified patent and that said Letters Patent is hereby corrected as shown below:

Title page,
Item [57], ABSTRACT,
Line 16, “form” should read -- from --; and
Line 18, “pattering” should read -- patterning --.

Column 1,
Line 63, “more” should be deleted.

Column 2,
Line 15, “ardent” should read -- recent --; and
Line 28, “view” should read -- views --.

Column 3,
Line 48, “priorly” should read -- poorly --; and
Line 51, “By with” should be deleted.

Column 5,
Line 41, “with-” should read -- with --;
Line 42, “out” should be deleted; and
Line 43, “contactness” should read -- contact --.

Column 6,
Line 9, “achiever” should read -- achieve --; and
Line 30, “pattering” should read -- patterning --.

Column 7,
Line 24, “form” should read -- from --;
Line 49, “contactness” should read -- contact --;
Line 52, “contactness” should read -- contact --; and
Line 57, “cavitation proof” should read -- cavitation-proof --.

Column 10,
Line 20, “cavitation proof” should read -- cavitation-proof --;
Line 49, “hundredth” should read -- hundreds --; and
Line 57, “hundredth” should read -- hundreds --.

Column 11,
Line 40, “plasm” should read -- plasma --; and
Line 50, “cavitation proof” should read -- cavitation-proof --.

UNITED STATES PATENT AND TRADEMARK OFFICE

CERTIFICATE OF CORRECTION

PATENT NO. : 6,491,834 B1
DATED : December 10, 2002
INVENTOR(S) : Masahiko Kubota et al.

It is certified that error appears in the above-identified patent and that said Letters Patent is hereby corrected as shown below:

Column 12,
Line 10, “cavitation proof” should read -- cavitation-proof --;
Line 47, “distant” should read -- distance --; and
Line 55, “each of” should be deleted.

Column 13,
Lines 4, 5 and 8, “cavitation proof” should read -- cavitation-proof --.

Column 14,
Lines 4, 31, 49 and 59, “cavitation proof” should read -- cavitation-proof --.

Column 15,
Line 3, “iron” should read -- ion --; and
Line 35, “cavitation proof” should read -- cavitation-proof --.

Column 16,
Line 8, “cavitation proof” should read -- cavitation-proof --;
Line 36, “is” should read -- are --;
Lines 37, 38 and 42, “cavitation proof” should read -- cavitation-proof --; and
Line 54, “iron” should read -- ion --.

Column 17,
Lines 7 and 49, “cavitation proof” should read -- cavitation-proof --; and
Line 53, “to” should read -- for --.

Column 18,
Lines 2 and 7, “contactness” should read -- contact --;
Line 21, “movables” should read -- movable --;
Line 33, “views-taken” should read -- views taken --; and
Line 61, “corresponds” should read -- corresponds to --.

Column 19,
Lines 17 and 37, “cavitation proof” should read -- cavitation-proof --;
Line 30, “FIG. 10C,” should read -- in FIG. 10C, --; and
Line 56, “protect” should read -- protection --.

Column 20,
Lines 6 and 63, “cavitation proof” should read -- cavitation-proof --; and

UNITED STATES PATENT AND TRADEMARK OFFICE

CERTIFICATE OF CORRECTION

PATENT NO. : 6,491,834 B1
DATED : December 10, 2002
INVENTOR(S) : Masahiko Kubota et al.

It is certified that error appears in the above-identified patent and that said Letters Patent is hereby corrected as shown below:

Column 20 cont'd,
Line 11, "referent" should read -- reference --.

Column 21,
Line 24, "is" should be deleted; and
Line 27, "neat" should read -- near --.

Column 22,
Line 35, "cavitation proof" should read -- cavitation-proof --; and
Line 43, "paths" (second occurrence) should read -- path --.

Column 23,
Lines 26 and 66, "cavitation proof" should read -- cavitation-proof --;
Line 36, "plasm" should read -- plasma --;
Line 41, "cavitation" should read -- cavitation- --; and
Line 58, "n" should read -- on --.

Column 24,
Line 1, "micro wave" should read -- microwave --.

Column 25,
Line 21, "cavitation proof" should read -- cavitation-proof --; and
Line 46, "which" should read -- which is --.

Column 26,
Line 5, "serves" should read -- serve --; and
Line 54, close up right margin.

Column 27,
Line 33, "etching proof" should read -- etching-proof --.

Column 28,
Line 55, "etching" should read -- etching- --;
Line 60, "cavitation proof" should read -- cavitation-proof --; and
Line 61, "tion proof" should read -- tion-proof --.

UNITED STATES PATENT AND TRADEMARK OFFICE

CERTIFICATE OF CORRECTION

PATENT NO. : 6,491,834 B1 
DATED : December 10, 2002
INVENTOR(S) : Masahiko Kubota et al.

It is certified that error appears in the above-identified patent and that said Letters Patent is hereby corrected as shown below:

Column 30,
Line 18, "movable" should read -- a movable --.

Column 32,
Line 4, "formation" should read -- formation of --.

Signed and Sealed this

Fifteenth Day of July, 2003

JAMES E. ROGAN
*Director of the United States Patent and Trademark Office*